US011371272B2

(12) United States Patent
Pesacov et al.

(10) Patent No.: US 11,371,272 B2
(45) Date of Patent: Jun. 28, 2022

(54) PORTABLE DOOR LOCK

(71) Applicants: Becky Berenika Pesacov, Thornhill (CA); Baruh Pesacov, Thornhill (CA)

(72) Inventors: Becky Berenika Pesacov, Thornhill (CA); Baruh Pesacov, Thornhill (CA)

( * ) Notice: Subject to any disclaimer, the term of this patent is extended or adjusted under 35 U.S.C. 154(b) by 0 days.

(21) Appl. No.: 17/345,160

(22) Filed: Jun. 11, 2021

(65) Prior Publication Data

US 2021/0396055 A1 Dec. 23, 2021

Related U.S. Application Data

(60) Provisional application No. 63/041,691, filed on Jun. 19, 2020.

(51) Int. Cl.

| | |
|---|---|
| ***E05C 17/04*** | (2006.01) |
| ***E05C 17/46*** | (2006.01) |
| ***E05C 17/30*** | (2006.01) |

(52) U.S. Cl.

CPC ..... *E05C 17/047* (2013.01); *E05C 17/30* (2013.01); *E05C 17/46* (2013.01)

(58) Field of Classification Search

CPC ..... E05C 17/00; E05C 17/02; E05C 17/04; E05C 17/045; E05C 17/047; E05C 17/12; E05C 17/18; E05C 17/30; E05C 17/44; E05C 17/46; E05C 17/48; E05C 17/50; E05C 19/003; E05C 19/005; E05C 19/007; E05C 19/18; E05C 19/182; E05C 19/184; E05C 19/188; Y10T 292/20; Y10T 292/218; Y10T 292/225; Y10T 292/228; Y10T 292/23; Y10T 292/237;

(Continued)

(56) References Cited

U.S. PATENT DOCUMENTS

| | | | |
|---|---|---|---|
| 1,083,904 | A | 1/1914 | Mertsheimer |
| 1,618,348 | A | 2/1927 | Nicolai |

(Continued)

FOREIGN PATENT DOCUMENTS

| | | | |
|---|---|---|---|
| CN | 106869643 | A * | 6/2017 |
| CN | 109610960 | A * | 4/2019 |

(Continued)

OTHER PUBLICATIONS

"Door Buddy Child Door Look and Foam Baby Door Stopper. Baby Proofing Doors Made Simple with Easy to", online product listing, Babycribbed.com, accessed on Nov. 18, 2019 (1 page).

*Primary Examiner* — Alyson M Merlino

(74) *Attorney, Agent, or Firm* — Bereskin & Parr LLP/S.E.N.C.R.L, s.r.l.; Tony Orsi; Nicholas Aitken

(57) ABSTRACT

Portable door locks are disclosed. One of the portable door locks includes i) a non-destructively removable door mount securable to a vertical door edge, ii) a deflection arm extending longitudinally from a distal arm end to a proximal arm end, and iii) a door frame engagement latch connected to the deflection arm proximate the distal arm end. The proximal arm end is connected to the door mount. The deflection arm is rotatable relative to the door mount between at least a biased position and a deflected position. The door frame engagement latch is movable relative to the deflection arm between at least a door frame latching position and a door frame gliding position. The door frame engagement latch is biased toward the door frame latching position.

11 Claims, 35 Drawing Sheets

(58) Field of Classification Search
CPC ..... Y10T 292/285; Y10T 292/286; Y10T 292/288; Y10T 292/289; Y10T 292/291; Y10T 292/293; Y10T 292/297; Y10T 292/299; Y10T 292/302; Y10T 292/304; Y10T 292/305; Y10T 292/34; Y10T 292/37; Y10T 292/373; Y10T 292/376; Y10T 292/379; Y10T 292/388; Y10T 292/391; Y10T 292/394; Y10T 292/397; Y10T 292/65; Y10T 292/67
See application file for complete search history.

(56) References Cited

U.S. PATENT DOCUMENTS

| | | | | | |
|---|---|---|---|---|---|
| 1,883,099 | A | * | 10/1932 | Ter Meer | E05C 1/163 292/169.19 |
| 2,194,510 | A | * | 3/1940 | Sasgen | E05C 17/443 292/338 |
| 2,565,906 | A | | 8/1951 | Berthene | |
| 2,924,476 | A | | 2/1960 | Deane | |
| 3,180,668 | A | * | 4/1965 | Brown | E05C 17/042 292/276 |
| 3,397,001 | A | | 8/1968 | Friedman | |
| 3,437,365 | A | | 4/1969 | Zadanoff et al. | |
| 3,451,235 | A | | 6/1969 | Weingart | |
| 3,593,996 | A | | 7/1971 | Thompson | |
| 3,620,483 | A | | 11/1971 | Weinberger | |
| 3,914,965 | A | | 10/1975 | Paxton | |
| 4,015,867 | A | | 4/1977 | Siden | |
| 4,043,578 | A | * | 8/1977 | Downs | E05C 19/182 292/290 |
| 4,254,976 | A | | 3/1981 | Shoberg | |
| 4,326,394 | A | | 4/1982 | Stein | |
| 4,552,395 | A | | 11/1985 | Dominguez | |
| 4,623,177 | A | | 11/1986 | McKinney | |
| 4,653,785 | A | | 3/1987 | Tobey | |
| 4,715,628 | A | | 12/1987 | Brink et al. | |
| 4,763,938 | A | | 8/1988 | Schlanger | |
| 4,982,474 | A | | 1/1991 | Kjellström | |
| 5,039,147 | A | | 8/1991 | Moon et al. | |
| 5,203,597 | A | | 4/1993 | Wheelock | |
| 5,228,737 | A | * | 7/1993 | Zimmerman | E05C 17/042 217/61 |
| 5,547,236 | A | | 8/1996 | Gregory | |
| D379,299 | S | | 5/1997 | Fitzgibbons | |
| 5,865,484 | A | * | 2/1999 | Johns | E05C 19/182 292/288 |
| 6,003,911 | A | | 12/1999 | Sowash | |
| 6,386,604 | B1 | | 5/2002 | Scanlon | |
| 6,454,323 | B1 | * | 9/2002 | Mills | E05C 19/004 16/82 |
| 6,510,587 | B2 | | 1/2003 | Urschel et al. | |
| 6,550,828 | B2 | | 4/2003 | Warden | |
| 6,604,764 | B2 | | 8/2003 | Zemzik | |
| 6,904,643 | B2 | | 6/2005 | Duffy | |
| 6,976,716 | B2 | | 12/2005 | Lin | |
| 7,226,094 | B2 | | 6/2007 | Swink | |
| 7,452,011 | B1 | | 11/2008 | Lind | |
| 8,177,266 | B2 | | 5/2012 | Yates | |
| 8,276,240 | B2 | | 10/2012 | Ritachka | |
| D675,900 | S | | 2/2013 | Lin | |
| 8,458,857 | B1 | | 6/2013 | Davis et al. | |
| 8,510,994 | B2 | | 8/2013 | Scott | |
| 8,544,899 | B2 | | 10/2013 | Hertrich | |
| 9,316,033 | B2 | * | 4/2016 | Yates | E05C 17/54 |
| 9,624,702 | B1 | | 4/2017 | Faulkner | |
| 10,094,158 | B2 | | 10/2018 | McRoskey et al. | |
| 10,273,729 | B2 | | 4/2019 | Webster | |
| 2006/0170226 | A1 | | 8/2006 | Konstantakis et al. | |
| 2014/0245798 | A1 | | 9/2014 | Beckman | |
| 2014/0312635 | A1 | | 10/2014 | Hansen et al. | |
| 2015/0097382 | A1 | | 4/2015 | Blawat | |
| 2017/0328101 | A1 | | 11/2017 | Corbett | |
| 2019/0112850 | A1 | * | 4/2019 | D'Souza | E05C 17/48 |
| 2020/0102774 | A1 | * | 4/2020 | Maher | E05C 17/045 |
| 2020/0362607 | A1 | * | 11/2020 | Srnoyachki | E05C 19/182 |

FOREIGN PATENT DOCUMENTS

| | | | | | |
|---|---|---|---|---|---|
| DE | 9305925 | U1 | * | 6/1993 | E05C 17/047 |
| DE | 20114210 | U1 | * | 1/2002 | E05C 17/04 |
| EP | 1051313 | B1 | | 6/2005 | |
| ES | 2392413 | A1 | | 12/2012 | |
| GB | 2230293 | A | | 10/1990 | |
| GB | 2438625 | A | | 12/2007 | |
| GB | 2490574 | A | | 11/2012 | |
| WO | 90/01605 | A1 | | 2/1990 | |
| WO | 03/080973 | A1 | | 10/2003 | |

* cited by examiner

PORTABLE DOOR LOCK

CROSS-REFERENCE TO RELATED APPLICATION

This application claims the benefit of U.S. Provisional Patent Application No. 63/041,691 filed Jun. 19, 2020, the entirety of which is incorporated herein by reference.

FIELD

This application relates to the field of door safety devices, and in particular to portable door locks that are removably mountable to a vertical door edge.

BACKGROUND

For safety reasons, it can be important to restrict a child's access within a living space (e.g., house, apartment, hotel room, etc.). Children permitted to move freely throughout the living space may be exposed to many environmental dangers. Access to stairs, sharp objects, choking hazards, and poisonous material are among the potential dangers. Households with pets may have similar concerns as those with children.

As a result, parents or guardians often elect to restrict a child's and/or a pet's access within the living space by closing various doors. However, children may be able to reach door handles and open doors from an early age (e.g., 8-10 months old). Similarly, pets (e.g., cats or dogs) may be able to open doors by pulling on the door handle or turning the doorknob with their limbs or mouth. Even if closing doors was an effective measure to restrict child and/or pet access to specific areas of the living space, it can create other safety concerns and inconveniences. For example, closing a door to a room can reduce or eliminate air circulation into that room. This may be a significant concern for parents and pet owners alike.

In some cases, children may refuse to sleep with their bedroom door fully closed. In other cases, parents or guardians may wish to keep a child's bedroom door partially open to allow for easier communication. In either case, fully closing the door may not be a practical solution for parents or guardians wanting to prevent children from wandering out of their room unattended.

Door locking devices for doors with various types of handles and knobs are known. Known door locking devices can be generally divided into two types: i) those that are connected to the door or door frame and ii) those that are connected to the door handle or knob.

Known door locking devices that are connected to the door or door frame often require a permanent connection using adhesives and/or mechanical fasteners (e.g., screws, nails, etc.). This can make them difficult, if not impossible, to remove without damaging the door or door frame. Further, many of these door locking devices can operate from only the side of the door or door frame on which they are connected. This may create one or more issues. For example, if the device is left in an engaged position and the door gets closed from the opposite side of where the device can be operated, the door may be unopenable from that side. This can lead to a dangerous situation were a child and/or a pet become accidentally trapped in a room without adult supervision. In addition, only being able to operate these kinds of door locking devices from the side of the door on which they are connected can reduce their overall versatility and user convenience.

Known door locking devices that are installed directly on the door handle or knob are not without issues. Children can reach these devices at a very young age and learn how to disengage them rather quickly (e.g., by playing with them or by watching their parents use them). In this way, these types of door locking devices can lose their effectiveness at restricting access.

DRAWINGS

SUMMARY

Figure 1A:
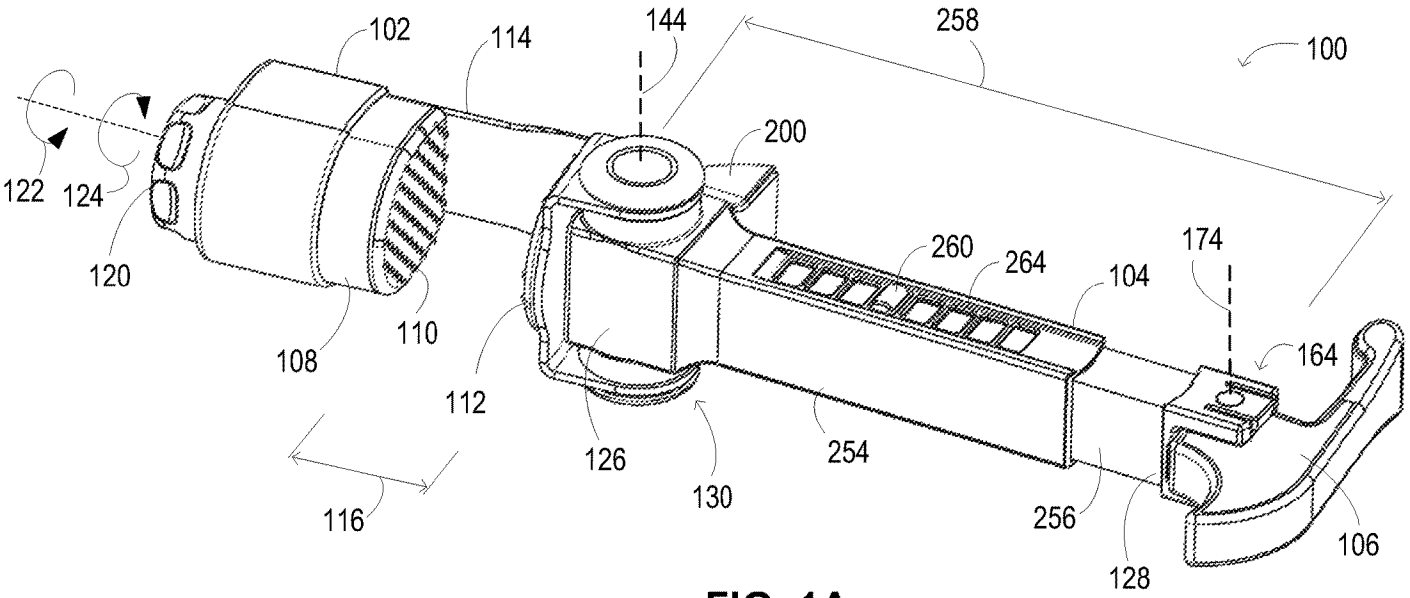
FIG. 1A is a front perspective view of a portable door lock, in accordance with a first embodiment.

In one aspect, a portable door lock is disclosed. The portable door lock includes (i) a non-destructively removable door mount securable to a vertical door edge, (ii) a deflection arm extending longitudinally from a proximal arm end to a distal arm end, and (iii) a door frame engagement latch connected to the deflection arm proximate the distal arm end. The proximal arm end is connected to the door mount. The deflection arm is rotatable relative to the door mount between at least a biased position and a deflected position. The door frame engagement latch is movable relative to the deflection arm between at least a door frame latching position and a door frame gliding position. The door frame engagement latch is biased toward the door frame latching position.

In another aspect, a portable door lock is disclosed. The portable door lock includes (i) a non-destructively removable door mount securable to a vertical door edge, (ii) a deflection arm extending longitudinally from a proximal arm end to a distal arm end, and (iii) a door frame engagement latch connected to the deflection arm proximate the distal arm end. The proximal arm end is connected to the door mount. The deflection arm is rotatable relative to the door mount between at least a biased position and a deflected position. The door frame engagement latch is movable relative to the deflection arm between a door frame latching position and a disabled position.

In another aspect, a portable door lock is disclosed. The portable door lock includes (i) a non-destructively removable door mount securable to a vertical door edge, (ii) a rigid deflection arm including a first arm segment and a second arm segment, and (iii) a door frame engagement latch. The first arm segment has a proximal arm end. The second arm segment has a distal arm end. The door frame engagement latch is connected to the second arm segment proximate the distal arm end. The proximal arm end is connected to the door mount. The deflection arm is rotatable relative to the door mount between at least a biased position and a deflected position. The deflection arm has an arm length from the proximal arm end to the distal arm end. The second arm segment is movable relative to the first arm segment to vary the arm length.

In another aspect, a portable door lock is disclosed. The portable door lock includes (i) a non-destructively removable door mount securable to a vertical door edge, (ii) a longitudinally extending deflection arm having a proximal arm end and an opposed distal arm end, and (iii) a door frame engagement latch connected to the deflection arm proximate the distal arm end. The proximal arm end is connected to the door mount. The deflection arm is rotatable relative to the door mount between at least a biased position and a deflected position. The deflection arm includes a door frame bumper proximate the proximal arm end. The door frame bumper extends transverse to the deflection arm. The door frame bumper extends laterally outboard of the door mount when the deflection arm is in the deflected position.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment", "embodiment", "embodiments", "the embodiment", "the embodiments", "one or more embodiments", "some embodiments", and "one embodiment" mean "one or more (but not all) embodiments of the present invention(s)", unless expressly specified otherwise.

The terms "including", "comprising" and variations thereof mean "including but not limited to", unless expressly specified otherwise. A listing of items does not imply that any or all of the items are mutually exclusive, unless expressly specified otherwise. The terms "a", "an" and "the" mean "one or more", unless expressly specified otherwise.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

Some elements herein may be identified by a part number, which is composed of a base number followed by an alphabetical or subscript-numerical suffix (e.g., 184*a*, or 184$_1$). Multiple elements herein may be identified by part numbers that share a base number in common and that differ by their suffixes (e.g., 184$_1$, 184$_2$, and 184$_3$). All elements with a common base number may be referred to collectively or generically using the base number without a suffix (e.g., 184).

Referring to FIGS. 1A-1E, a portable door lock 100 is shown in accordance with an embodiment. When mounted to a door's vertical edge, portable door lock 100 can act as a latch that restricts opening of the door past a partially open position (e.g., see FIG. 7). In this manner, portable door lock 100 may be used to selectively limit or prevent the movement of children and/or pets into specific areas (e.g., the garage, the basement, a specific bedroom, etc.). Portable door lock 100 includes a door mount 102, a deflection arm 104 and a door frame engagement latch 106.

Door mount 102 can be secured to a vertical door edge in any manner that provides a firm connection (e.g., one that limits slipping). For example, door mount 102 may be configured as a "C"-shaped bracket or clamp that grips the vertical door edge by applying pressure from opposite sides of the door. Alternatively, or in addition, door mount 102 can be secured to the vertical door edge with adhesives (e.g., glue, tape, etc.) and/or mechanical fasteners (e.g., screws, nails, etc.).

In the example shown, door mount 102 is a non-destructively removable door mount. As used herein, "non-destructively removable" means that door mount 102 can be attached, removed, and reattached to a vertical door edge without causing any permanent damage, change and/or transformation to the door. Non-destructively removable door mount 102 explicitly excludes any door mount that use wall anchors, screws, single-use adhesives (e.g., curing adhesive), etc. to attach to the vertical door edge. In addition to providing a firm connection with the vertical door edge, non-destructively removable door mount 102 facilitates attachment and detachment that does not damage the door or door mount 102.

Figure 1B:
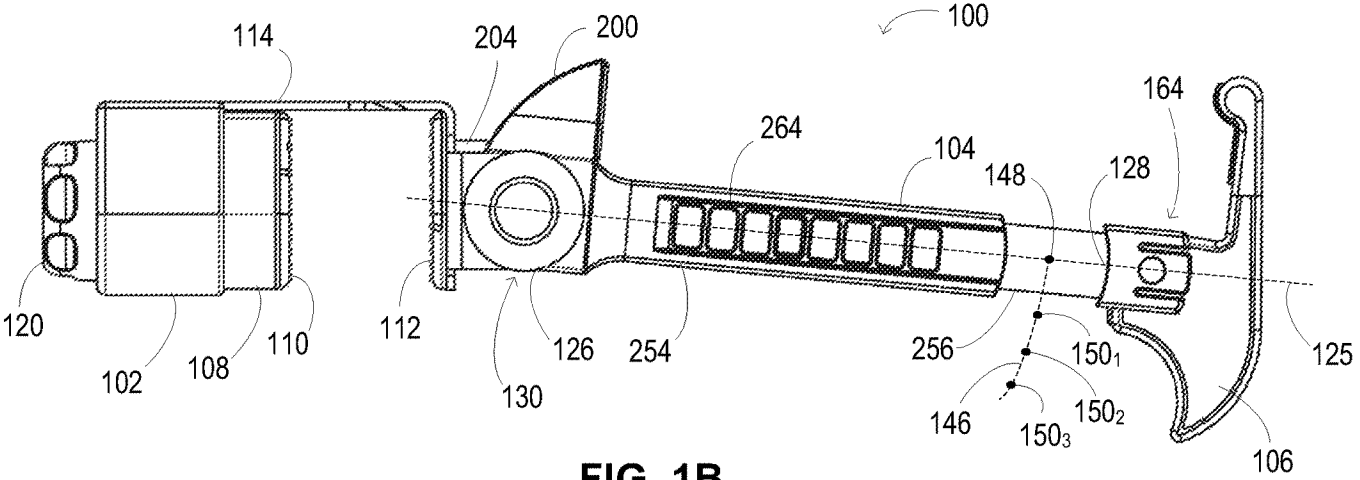
FIGS. 1B-1D are top, front and side views of the portable door lock of FIG. 1A, respectively.
Figure 1C:
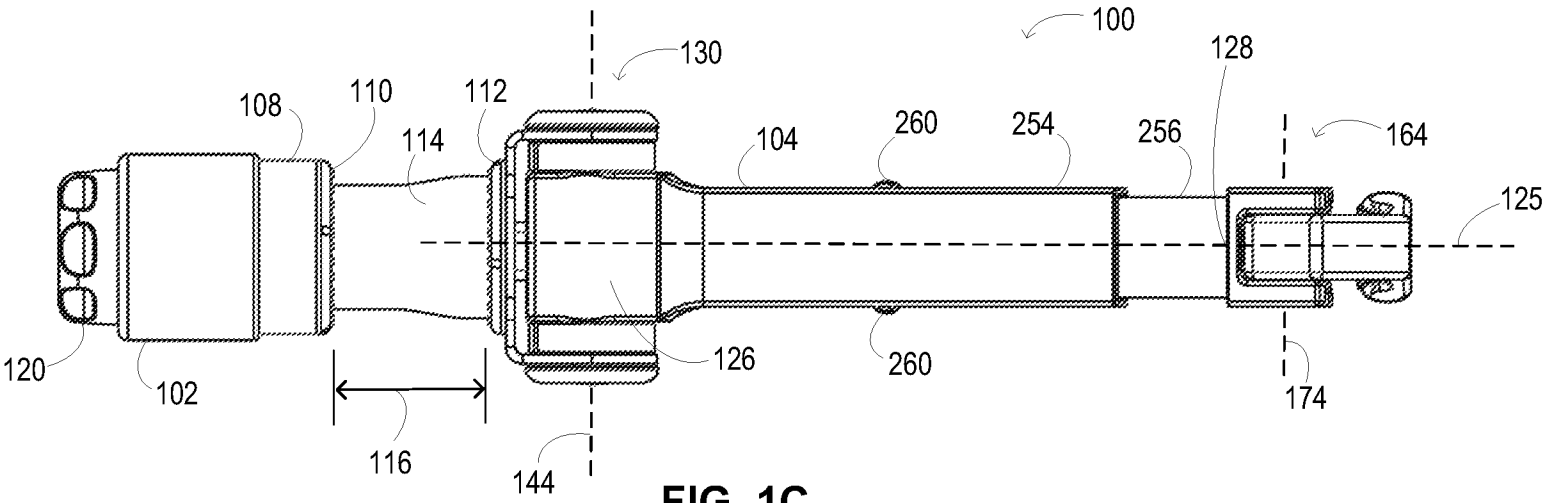
Figure 1D:
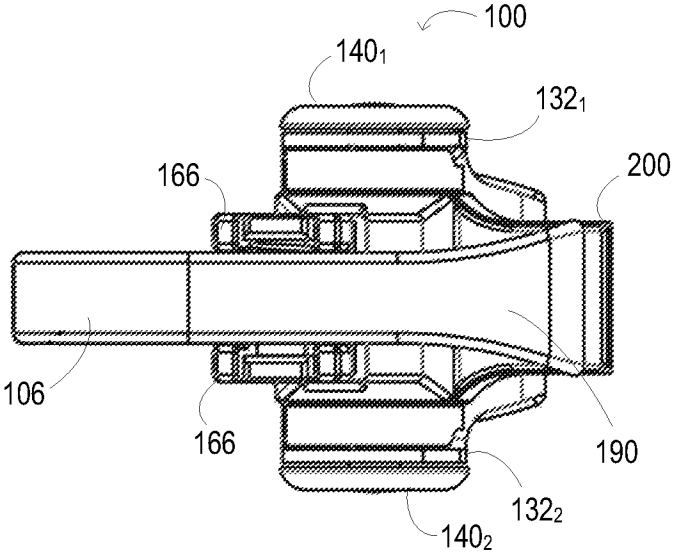
Figure 2:
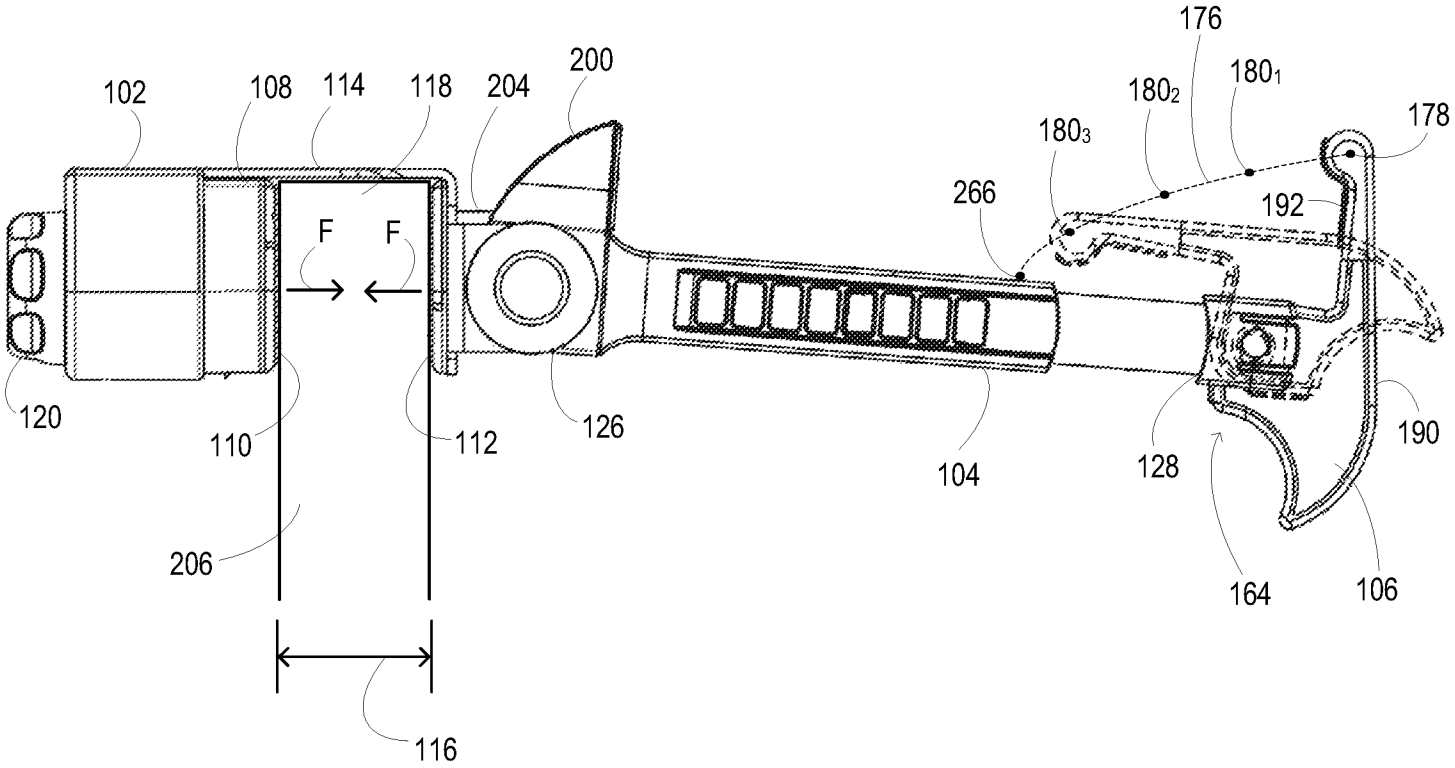
FIG. 2 is a top view of the portable door lock of FIG. 1A mounted to the vertical edge of a door, showing a door frame engagement latch of the portable door lock moved between door frame latching and door frame gliding positions.

As shown, door mount 102 includes a clamp 108. Referring to FIGS. 1A-1C, clamp 108 includes spaced apart first and second jaws 110, 112 joined by a planar jamb member 114. First and second jaws 110, 112 define a door clamping gap 116 therebetween. FIG. 2 shows door mount 102 secured to a vertical door edge 118 by clamp 108. First and second jaws 110, 112 exert opposed holding forces F that act to secure (i.e., hold) door mount 102 to vertical door edge 118. As shown, planar jamb member 114 preferably has a slim profile. Most doors have very little clearance between vertical door edge 118 and the door jamb when closed (e.g., less than 5 mm). The slim profile of planar jamb member 114 can allow the door to be fully closed while door mount 102 is secured to vertical door edge 118 (e.g., see FIG. 13). The thickness of planar jamb member 114 is sized to be less than 5 mm (e.g., less the 4 mm, such as for example 1 to 3 mm) so that it can fit between vertical door edge 118 and the door jamb when the door is closed.

In some embodiments, at least one of first and second jaws 110, 112 is movable relative to jamb member 114 to adjust door clamping gap 116. Doors come in many different thicknesses. Being able to adjust the door clamping gap 116 allows door mount 102 to be secured on doors with a range of thicknesses. Accordingly, door mount 102 can be secured on any interior or exterior doors that fall within the supported range of door thicknesses. As an example, door clamping gap 116 may be adjusted to accommodate doors with thicknesses equal to or less than 2 inches (5.08 cm) (e.g., thicknesses between 1 inch (2.54 cm) and 2 inches (5.08 cm)). As another example, door clamping gap 116 may be adjusted to accommodate doors with thicknesses between 1.375 inches (3.49 cm) and 1.75 inches (4.45 cm). In other embodiments, door clamping gap 116 may be adjustable to accommodate door thickness outside these ranges.

In the example shown, first jaw 110 is movable relative to jamb member 114 to adjust door clamping gap 116. First jaw 110 may be movable relative to jamb member 114 in any way that allow for door clamping gap to be adjusted. For example, clamp 108 may include a hex cap screw rotatable by Allen™ key for moving first jaw 110 relative to jamb member 114. FIG. 1A shows an example in which clamp 108 includes an adjustment dial 120 that is rotatable to move first jaw relative to jamb member 114. Rotation of adjustment dial 120 in a clockwise direction 122 moves first jaw 110 toward second jaw 112 and thereby narrows door clamping gap 116. Rotation of adjustment dial 120 in a counterclockwise direction 124 moves first jaw 110 away from second jaw 112 and thereby widens door clamping gap 116. In other embodiments, the rotation directions 122, 124 to move jaw 110 towards and away from second jaw 112 are reversed.

Referring again to FIG. 2, vertical door edge 118 can be positioned between first and second jaws 110, 112 when door clamping gap 116 is at least slightly wider than the door's thickness. Once positioned, adjustment dial 120 can be rotated in clockwise direction 122 (FIG. 1) to tighten first and second jaws 110, 112 against opposite sides of the door, thereby securing door mount 102 to vertical door edge 118. To detach door mount 102 from vertical door edge 118, adjustment dial 120 can be rotated in counterclockwise direction 124 (FIG. 1) to loosen first and second jaws 110, 112 from opposite sides of the door (i.e., widen door clamping gap 116).

Deflection arm 104 extends longitudinally from a proximal arm end 126 to a distal arm end 128. As shown in FIG. 1B, proximal and distal arm ends 126, 128 are located on an arm axis 125. Proximal arm end 126 is connected to door mount 102. Proximal arm end 126 can be connected to door mount 102 in any manner that allows deflection arm 104 to rotate relative to door mount 102 between a biased position and at least one deflected position. For example, proximal arm end 126 can be connected to door mount 102 by a hinge, a swivel, or a ball and socket joint. As will be described below, the ability of deflection arm 104 to rotate relative to door mount 102 can allow deflection arm 104 to deflect in response to contact between door frame engagement latch 106 and the door frame as the door is moved toward a closed position.

Figure 1E:
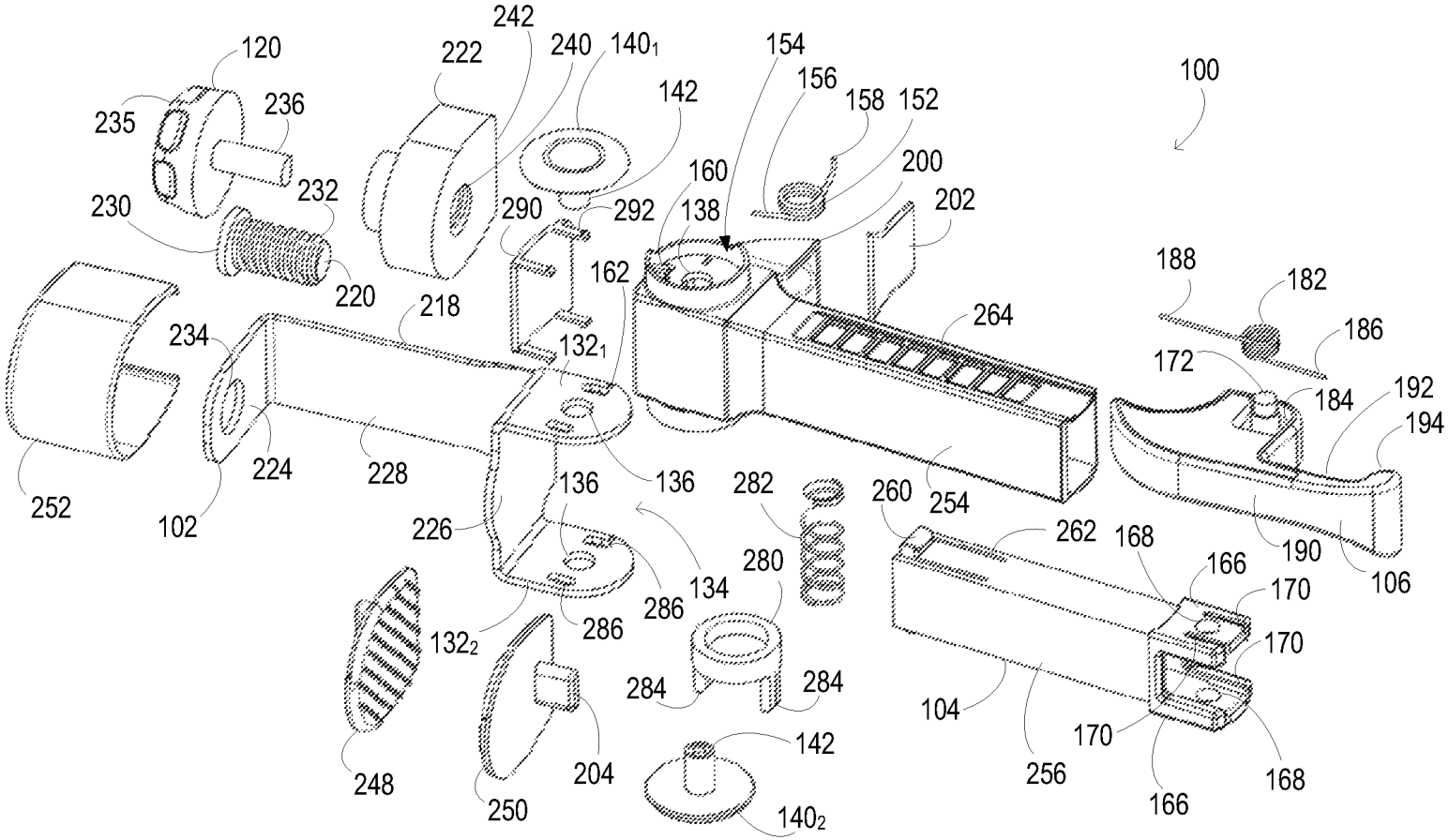
FIG. 1E is an exploded front perspective view of the portable door lock of FIG. 1A.

In the example shown, proximal arm end 126 is rotatably connected to door mount 102 at arm pivot joint 130. As described below, features of both door mount 102 and proximal arm end 126 cooperate to provide arm pivot joint 130. Referring to FIG. 1E, door mount 102 includes spaced apart upper and lower tabs 132$_1$, 132$_2$ that define an arm receiving slot 134 therebetween. Each tab 132$_1$, 132$_2$ includes a tab aperture 136. Proximal arm end 126 includes opposed upper and lower rod apertures 138 (the lower rod aperture is not visible in FIG. 1E). Deflection arm 104 is connected to door mount 102 by positioning proximal arm end 126 within arm receiving slot 134 so that each rod aperture 138 is aligned with a corresponding tab aperture 136. Upper and lower joint caps $140_1$, $140_2$ are connected to secure deflection arm 104 to door mount 102. Each joint cap $140_1$, $140_2$ includes an engagement rod 142 that is sized to fit through an aligned pair of tab and rod apertures 136, 138.

In one alternative embodiment, rotation of deflection arm 104 relative to door mount 102 may involve resiliently bending deflection arm 104 without permanent deformation. For example, deflection arm 104 may bend along its length to allow rotation between biased and deflected positions. In another alternative embodiment, deflection arm 104 may bend at proximal arm end 126 to allow rotation between biased and deflected positions. In each of these alternative embodiments, deflection arm 104 may be at least partially formed of a flexible and resilient material (e.g., polypropylene, polyvinyl chloride, etc.), which can bend as required by the present design and return to its original unbent state having undergone no permanent deformation.

In some embodiments, deflection arm 104 is rotatable relative to door mount 102 about a deflection axis that extends transverse to deflection arm 104. As used herein, "transverse" means within 45 degrees of perpendicular. Deflection arm 104 may rotate about the deflection axis from the biased position to one of many possible deflected positions. For example, deflection arm 104 may rotate up to 30 degrees (e.g., 5 to 30 degrees) between biased and deflected positions. In use, deflection arm 104 rotates from its biased position to a deflected position in response to contact between door frame engagement latch 106 and the door frame. The extent to which deflection arm 104 rotates between biased and deflected positions depends on various factors, such as, for example, the length of deflection arm 104 and type of the door frame (e.g., molding shape). In one configuration, deflection arm 104 may rotate 5 degrees between biased and deflected positions. In another configuration, deflection arm 104 may rotate 20 degrees between biased and deflected positions.

In the example shown, arm pivot joint 130 has a deflection axis 144 about which deflection arm 104 is rotatable relative to door mount 102. As shown, deflection axis 144 extends perpendicular to deflection arm 104. Referring to FIG. 1B, arm pivot joint 130 allows (e.g., constrains) deflection arm 104 to rotate along an arcuate path 146 between a biased position 148 and a plurality of deflected positions 150, e.g., $150_1$, $150_2$ and $150_3$.

Deflection arm 104 is biased toward biased position 148. The biasing of deflection arm 104 can be provided in any means that causes deflection arm 104 to move from deflected position 150 to biased position 148 in the absence of an external force. For example, one or more biasing members (e.g., springs, elastics) can be provided at the joint between proximal arm end 126 and door mount 102. Upon release of a force that has caused the rotation of deflection arm 104 to deflected position 150, the one or more biasing members may act to return deflection arm 104 to biased position 148.

In the example shown, arm pivot joint 130 includes an arm torsion spring 152 that acts to bias deflection arm 104 toward biased position 148. Referring to FIG. 1E, arm torsion spring 152 is positioned within a spring cavity 154 located at proximal arm end 126. Arm torsion spring 152 extends from a spring arm end 156 to a spring mount end 158. Spring arm end 156 is held within a spring retaining clip 160 that is located within spring cavity 154. Spring mount end 158 is engaged with a spring retaining aperture 162 formed in upper tab $132_1$ of door mount 102. Accordingly, arm torsion spring 152 interacts with deflection arm 104 and door mount 102 through spring arm end 156 and spring mount end 158, respectively. It is through this interaction that arm torsion spring 152 can exert force to bias deflection arm 104 toward biased position 148. In alternative embodiments, arm pivot joint 130 may include two arm torsion springs 152 (e.g., one at the top and one at the bottom of proximal arm end 126).

Deflection arm 104 is shown as a straight arm (i.e., no curving between proximal and distal arm ends 126, 128). In alternative embodiments, the deflection arm may have a curved or bowed configuration. Straight deflection arms may allow for simpler operation and/or easier manufacturing than curved and bowed configurations. Deflection arm 104 can have any suitable cross-sectional shape (e.g., round, square, triangular, etc.). In the example shown, deflection arm 104 has a generally rectangular cross-section.

Referring to FIGS. 1A-1B, door frame engagement latch 106 is connected to deflection arm 104 proximate distal arm end 128 (e.g., within 5 cm or 15% percent of the arm length from distal arm end 128). In the example shown, door frame engagement latch 106 is connected to deflection arm 104 at distal arm end 128. Deflection arm 104 can be rigidly connected or movably connected to door frame engagement latch 106 in various ways. For example, door frame engagement latch 106 can be movably connected to deflection arm 104 by a hinge, a swivel, or a ball and socket joint. Other exemplary ways of rigidly and movably connecting deflection arm 104 and door frame engagement latch 106 are described below.

In the example shown, door frame engagement latch 106 is rotatably connected to deflection arm 104 at a latch pivot joint 164. As described below, features of both door frame engagement latch 106 and distal arm end 128 cooperate to provide latch pivot joint 164. Referring to FIG. 1E, deflection arm 104 includes spaced apart and opposed tabs 166. Each tab 166 includes a tab aperture 168 positioned between a pair of longitudinal cuts 170. Door frame engagement latch 106 includes opposed upper and lower latch pivot pins 172 (lower latch pivot pin 172 is not visible in FIG. 1E). Door frame engagement latch 106 is connected to deflection arm 104 by engaging (e.g., snapping) upper and lower latch pivot pins 172 with a corresponding tab aperture 168. Longitudinal cuts 170 allow each tab 166 to bend (without permanent deformation) so that tab apertures 168 may accept corresponding latch pivot pins 172.

Door frame engagement latch 106 is rotatable relative to deflection arm 104 about a latch axis that extends transverse to deflection arm 104 (i.e., transverse to arm axis 125). Door frame engagement latch 106 may rotate about the latch axis from a door frame latching position to at least one door frame gliding position. Door frame engagement latch 106 may rotate up to 120 degrees (e.g., from 35 to 120 degrees) between door frame latching and door frame gliding positions. In use, door frame engagement latch 106 rotates from its door frame latching position to a door frame gliding position in response to contact with the door frame. The extent to which door frame engagement latch 106 rotates between door frame latching and door frame gliding positions depends on various factors, such as, for example, the length of deflection arm 104 and type of the door frame (e.g., molding shape). In one configuration, door frame engagement latch 106 may rotate 85 degrees between door frame latching and door frame gliding positions. In another configuration, door frame engagement latch 106 may rotate 55 degrees between door frame latching and door frame gliding positions.

In the example shown, latch pivot joint 164 has a latch axis 174 about which door frame engagement latch 106 is rotatable relative to deflection arm 104. As shown, latch axis 174 extends perpendicular to deflection arm 104 (i.e., perpendicular to arm axis 125). Referring to FIG. 2, latch pivot joint 164 allows (e.g., constrains) door frame engagement latch 106 to rotate along an arcuate path 176 between a door frame latching position 178 and a plurality of door frame gliding positions 180, e.g., $\mathbf{180}_1$, $\mathbf{180}_2$ and $\mathbf{180}_3$.

In the example shown, door frame engagement latch 106 is biased toward door frame latching position 178. The biasing of door frame engagement latch 106 can be provided by any means that causes door frame engagement latch 106 to move from door frame gliding position 180 to door frame latching position 178 in the absence of an external force. For example, one or more biasing members (e.g., springs, elastics) can be provided at the joint between door frame engagement latch 106 and deflection arm 104. Upon release of a force that has caused the rotation of door frame engagement latch 106 to door frame gliding position 180, the one or more biasing members may act to return door frame engagement latch 106 to door frame latching position 178. In alternative embodiments, door frame engagement latch 106 may not be biased toward door frame latching position 178. In these embodiments, door frame engagement latch 106 can be moved manually between at least door frame latching and door frame gliding positions.

Figure 3:
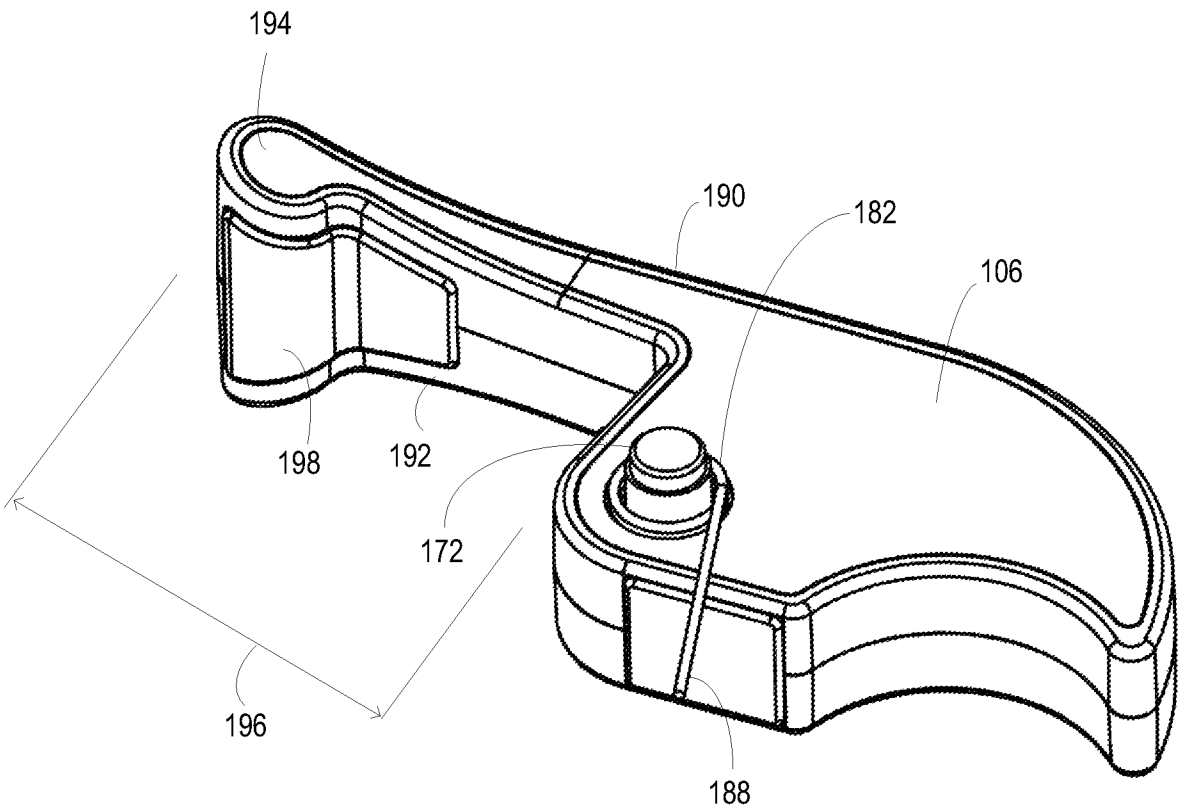
FIG. 3 is a side perspective view of a door frame engagement latch that may be used with the portable door lock of FIG. 1A.

In the example shown, latch pivot joint 164 includes a latch torsion spring 182 that acts to bias door frame engagement latch 106 toward door frame latching position 178. Referring to FIGS. 1E and 3, latch torsion spring 182 is positioned within a latch spring cavity 184 that surrounds upper latch pin 172. As shown in FIG. 3, upper latch pin 172 extends through latch torsion spring 182. Latch torsion spring 182 extends from a spring latch end 186 to a spring arm end 188. Spring latch end 186 is held within a spring retaining slot (not shown) provided within door frame engagement latch 106. Spring arm end 188 engages (i.e., abuts) an internal wall of deflection arm 104. Accordingly, latch torsion spring 182 interacts with door frame engagement latch 106 and deflection arm 104 through spring latch end 186 and spring arm end 188, respectively. It is through this interaction that latch torsion spring 182 can exert force to bias door frame engagement latch 106 toward door frame latching position 178. In alternative embodiments, latch pivot joint 164 may include two latch torsion springs 182 (e.g., one on each side of door frame engagement latch 106).

Various configurations of door frame engagement latch 106 are possible. Door frame engagement latch 106 may have any configuration that allows it to grab, latch onto, or otherwise engage with the door frame (or the wall surrounding the door in cases where there is no door frame). In some embodiments, door frame engagement latch 106 may have a "hook"-like appearance. Referring to FIG. 3, in the example shown, door frame engagement latch 106 has an elongated and curved distal face 190 and a finger portion 192. As will be described below, elongated and curved distal face 190 can allow door frame engagement latch 106 to slide smoothly across the door jamb during a locking process. Finger portion 192 extends transverse to deflection arm 104 when door frame engagement latch 106 is in a door frame latching position. As shown in FIG. 2, finger portion 192 extends at an angle of about 90 degrees to deflection arm 104 in door frame latching position 178. All else being equal, finger portion 192 that extend at an angle between 75 and 100 degrees to deflection arm 104 in door frame latching position 178 provide better engagement between finger portion 192 and the door frame/door molding than those that do not.

Referring again to FIG. 3, finger portion 192 has a rounded retaining head 194 at its distal end. As will be described below, the bulbous shape of rounded retaining head 194 allows finger portion 192 to engage with (e.g., grab onto) a variety of door molding types (i.e., different shapes and sizes). Finger portion 192 may have any finger length 196 suitable for engaging with any one or more of a range of door mouldings. Preferably, finger length 196 is at least 1.2 inches (3 cm) (e.g., 1.2 inches (3 cm) to 5 inches (12.7 cm)). In one example, finger length 196 may be 2 inches (5.08 cm). In another example, finger length 196 may be 4 inches (10.16 cm). All else being equal, a longer finger length 196 can engage with a greater variety of door moldings types than a shorter one. In other embodiments, finger length 196 may be greater or less than the example values above.

In the example shown, door frame engagement latch 106 includes a latch pad 198 located in the vicinity of rounded retaining head 194. In use, rounded retaining head 194 contacts the door frame (e.g., see FIG. 7). Therefore, latch pad 198 may act to protect the door frame from possible damage caused by such contact. Latch pad 198 may be connected to door frame engagement latch 106 in any suitable fashion (e.g., adhesive, mechanical fasteners, press fit, etc.). Latch pad 198 is at least partially made of a soft material, such as, for example, rubber or foam. In alternative embodiments, latch pad 198 may be omitted from door frame engagement latch 106. In some such embodiments, door frame engagement latch 106 itself may be at least partially made of a soft material and/or coated with a soft material in the vicinity of rounded retaining head 194.

Referring to FIGS. 1A-1B and 2, deflection arm 104 include a door frame bumper 200 at proximal arm end 126. Bumper 200 extends transverse to deflection arm 104. As shown in FIG. 2, bumper 200 extends laterally outboard of door mount 102. More specifically, bumper 200 extends laterally outboard of planar jamb member 114. Bumper 200 may extend laterally outboard of door mount 102 both when deflection arm 104 is in biased position 148 and in deflection position 150. This may prevent bumper 200 from passing through the door opening during a locking process. Effectively, bumper 200 extends laterally to such an extent that it contacts the proximal side of the door frame, thereby obstructing its passage into the door opening. In use, bumper 200 acts to keep the door slightly open (e.g., see FIG. 7). By preventing the full closure of the door, bumper 200 may also act to reduce hand and finger injuries caused when the door closes with a hand or fingers in the way. In alternative embodiments, deflection arm 104 may not include a door frame bumper.

Referring to FIGS. 1A and 1E, door frame bumper 200 includes a bumper pad 202. Bumper pad 202 is located on the face of door frame bumper 200 that contacts the door frame. In this manner, bumper pad 202 may act to protect the door frame from possible damage. Bumper pad 202 may be connected to door frame bumper 200 in any suitable fashion (e.g., adhesive, mechanical fasteners, press fit, etc.). In the example shown, bumper pad 202 is sized such that it connects to door frame bumper 200 via snap fit. Preferably, bumper pad 202 is at least partially made of a soft material, such as, for example, rubber or foam. In alternative embodiments, bumper pad 202 may be omitted. In some such embodiments, door frame bumper 200 itself may be at least partially made of a soft material and/or coated with a soft material to protect the door frame from possible damage.

Referring to FIG. 1B, deflection arm 104 can extend at an angle between 60 and 90 degrees to second jaw 112 when deflection arm 104 is in the biased position. More preferably, deflection arm 104 extends at an angle between 70 and 85 degrees to second jaw 112 when deflection arm 104 is in the biased position. Having deflection arm 104 extend at an angle between 60 and 90 degrees to second jaw 112 in the biased position may allow for smoother travel of door frame engagement latch 106 across the door frame during a locking process compared to embodiments in which deflection arm 104 extends perpendicular to second jaw 112. In the example shown, deflection arm 104 extends at an angle of about 75 degrees to second jaw 112 when deflection arm 104 is in biased position 148. Accordingly, when door mount 102 is secured to vertical door edge 118 as shown in FIG. 2, deflection arm 104 extends at an angle of about 75 degrees to the door 206 when deflection arm 104 is in biased position 148. As noted above, having deflection arm 104 extend at such an angle in the biased position can promote smooth travel of door frame engagement latch 106 across the door frame during a locking process.

Figure 4A:
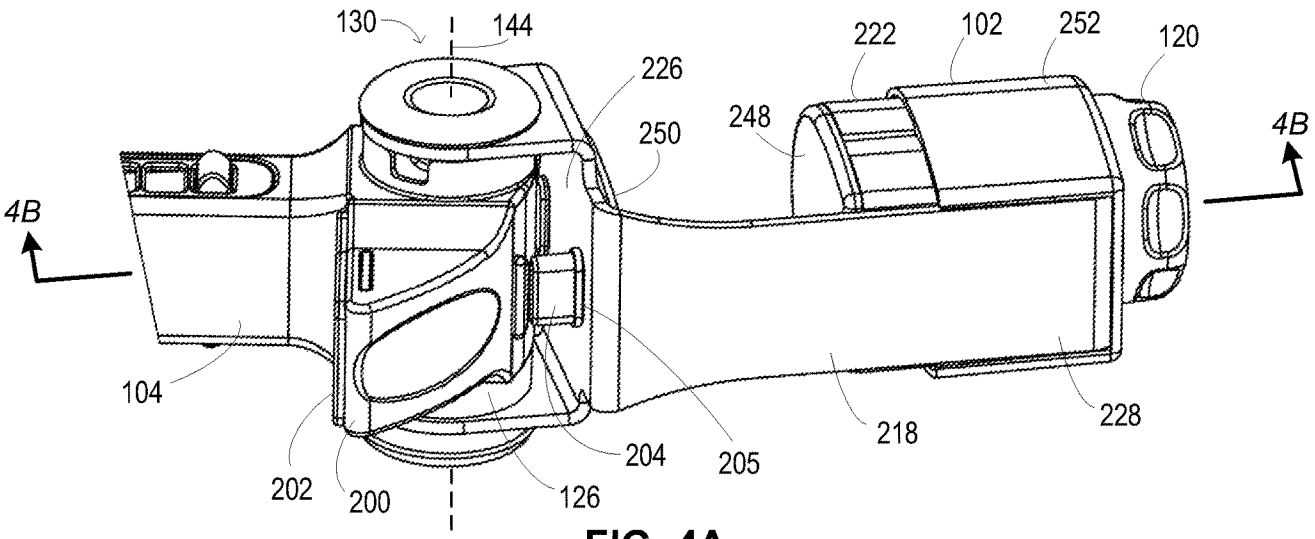
FIG. 4A is a partial rear perspective view of the portable door lock of FIG. 1A.

Deflection arm 104 can be maintained at an angle relative to second jaw 112 in any suitable fashion. In the example shown, door mount 102 includes an arm stop 204. With reference to FIGS. 2 and 4A, arm stop 204 extends into the rotational path of deflection arm 104. Arm stop 204 contacts proximal arm end 126 when deflection arm 104 is in biased position 148. In this manner, arm stop 204 impedes the rotation of deflection arm 104 past biased position 148 (in a direction from deflection position 150 to biased position 148). As described above, this rotation may be caused by arm torsion spring 152 (FIG. 1E) as it acts to return deflection arm 104 to biased position 148 from deflected position 150. Arm stop 204 preferably has a soft external covering (e.g. rubber) to protect against damage caused from repeated contact with deflection arm 104. In alternative embodiments, arm stop 204 does not have a soft external covering. In some embodiments, door mount 102 does not include an arm stop 204.

Figure 5A:
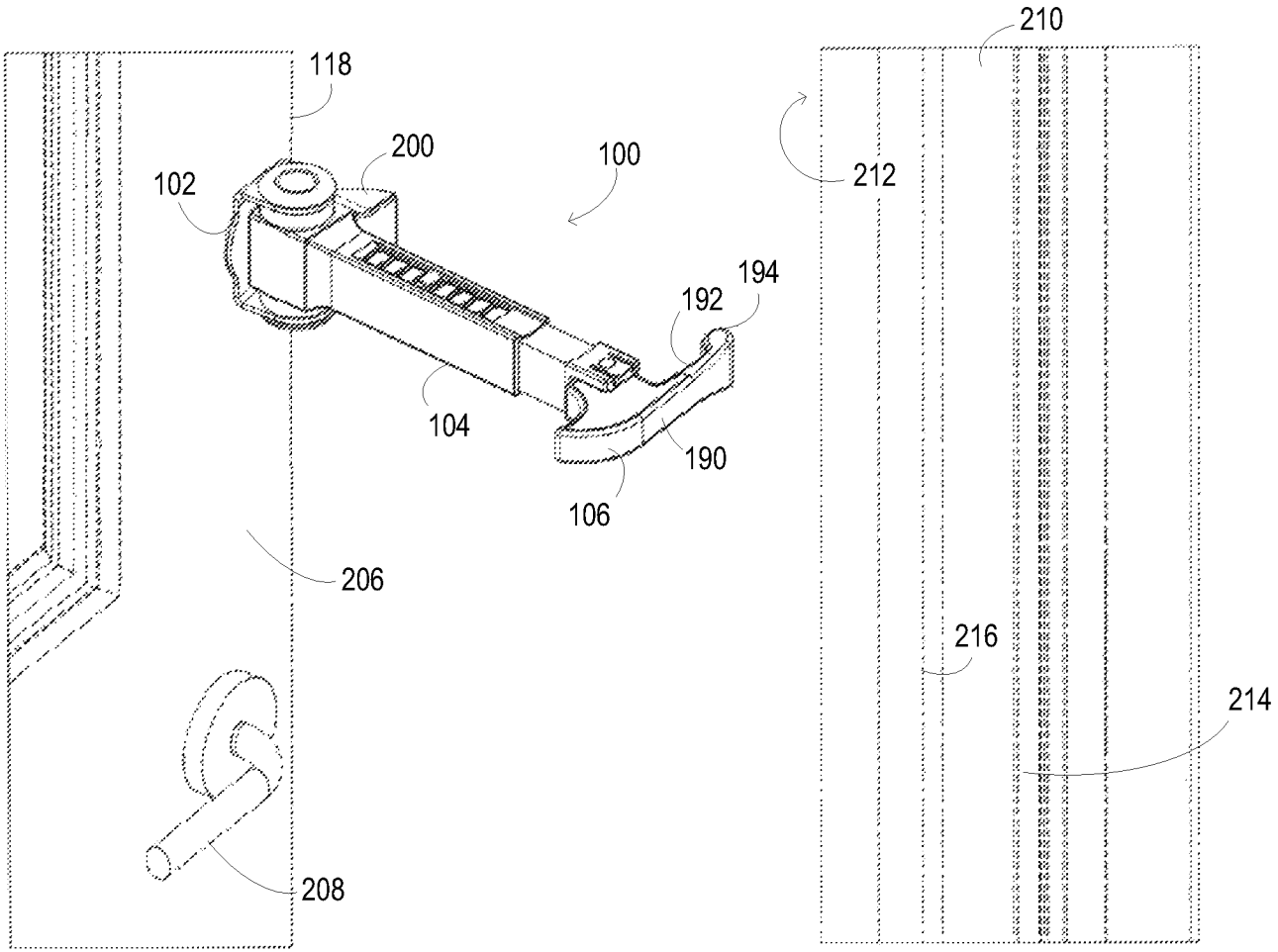
FIGS. 5A-5C are side perspective views illustrating an exemplary door locking process using the portable door lock of FIG. 1A.
Figure 5B:
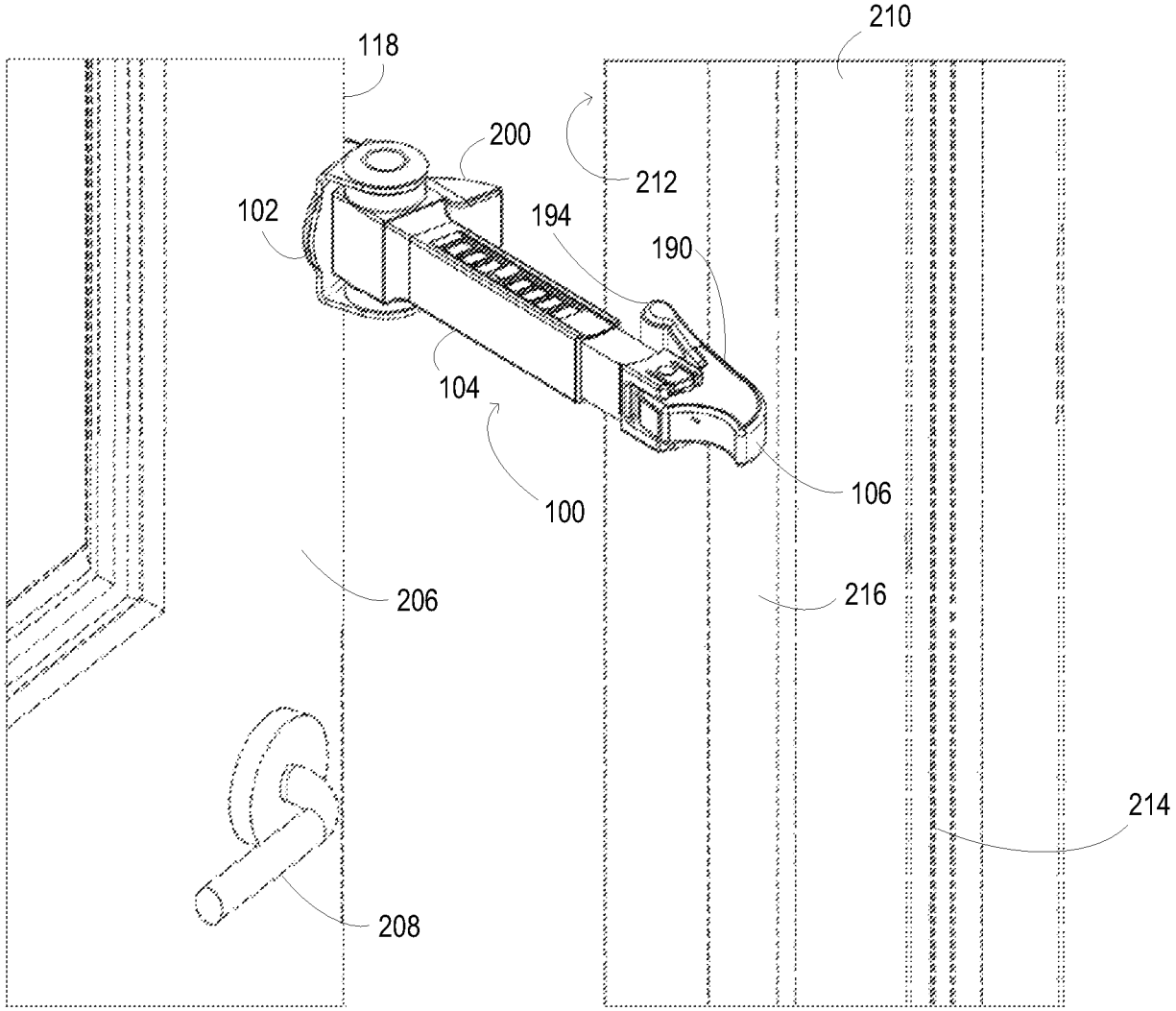
Figure 5C:
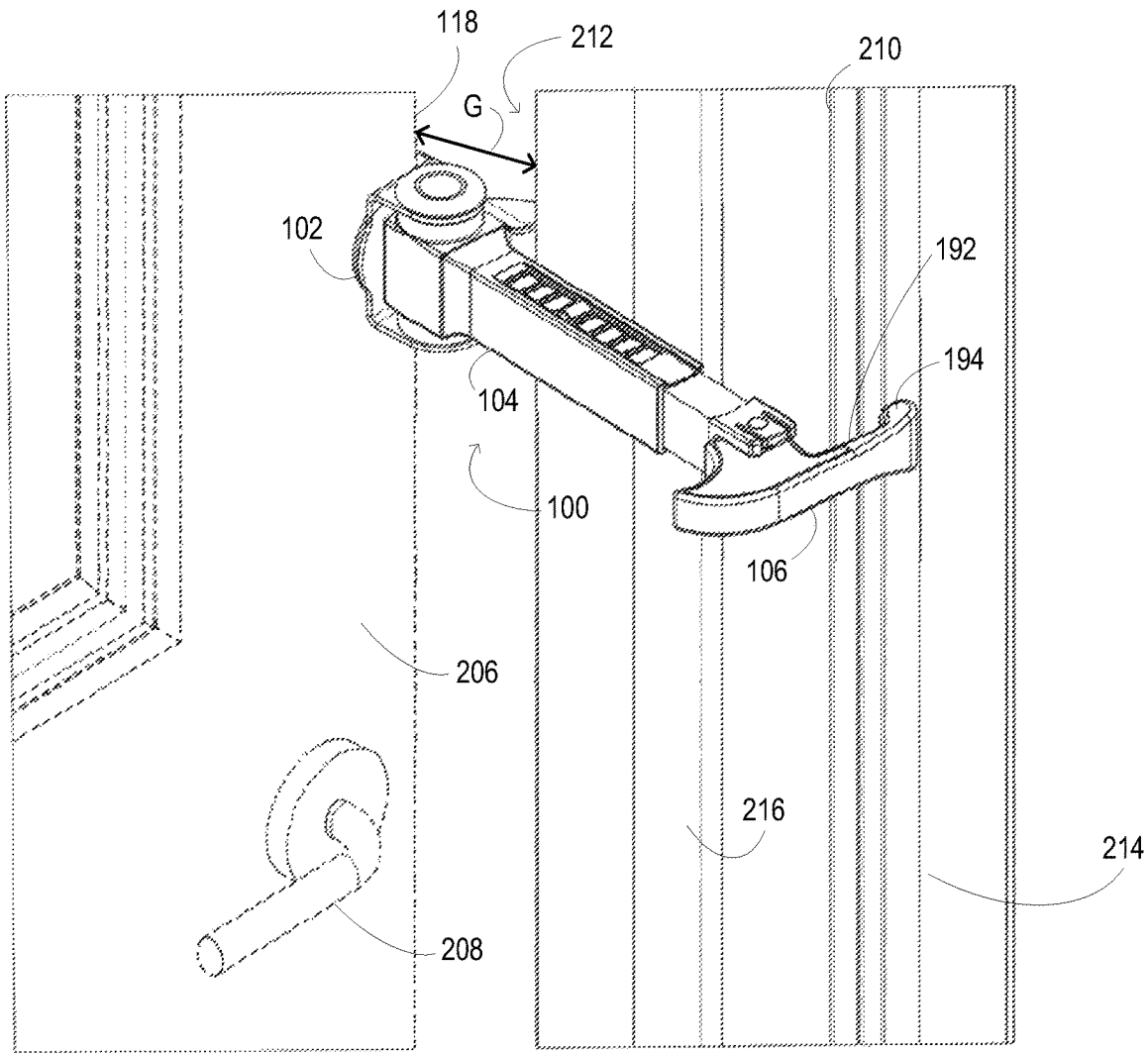

Reference is now made to FIGS. 5A-5C to illustrate an exemplary door locking process using portable door lock 100 of FIGS. 1A-1E. Referring to FIG. 5A, door mount 102 of portable door lock 100 is shown secured to vertical door edge 118 of door 206. As shown, portable door lock 100 is mounted above door handle 208. In this manner, portable door lock 100 can be positioned so that it is out of reach of children and/or pets that would otherwise be able to reach and operate door handle 208. Parents, guardians, and pet owners alike can selectively mount portable door lock 100 at any point along vertical door edge 118. For example, they may position portable door lock 100 at a height from the floor where one or more children and/or one or more pets cannot reach it. In other cases, parents or guardians can position portable door lock 100 at a height from the floor where an older (taller) child can reach it, but a younger (shorter) child cannot.

Referring still to FIG. 5A, deflection arm 104 is shown in biased position 148 (FIG. 1B) and door frame engagement latch 106 is shown in door frame latching position 178 (FIG. 2). To begin the door locking process, door 206 is rotated so that vertical door edge 118 is brought closer to door frame 210 (i.e., door 206 is rotated toward its typical closed position).

FIG. 5B shows portable door lock 100 shortly after door frame engagement latch 106 contacts door frame 210. Door frame engagement latch 106 is now in a door frame gliding position. As compared to FIG. 5A, contact between door frame engagement latch 106 and door frame 210 has caused door frame engagement latch 106 to rotate from the door frame latching position to the door frame gliding position. Elongated and curved distal face 190 can allow for smooth travel of door frame engagement latch 106 across door frame 210 (i.e., from proximal frame side 212 to distal frame side 214) as door 206 rotates toward its closed position. Those skilled in the art commonly refer to the portion of door frame 210 between proximal and distal frame sides 212, 214 as the door jamb.

Figure 6:
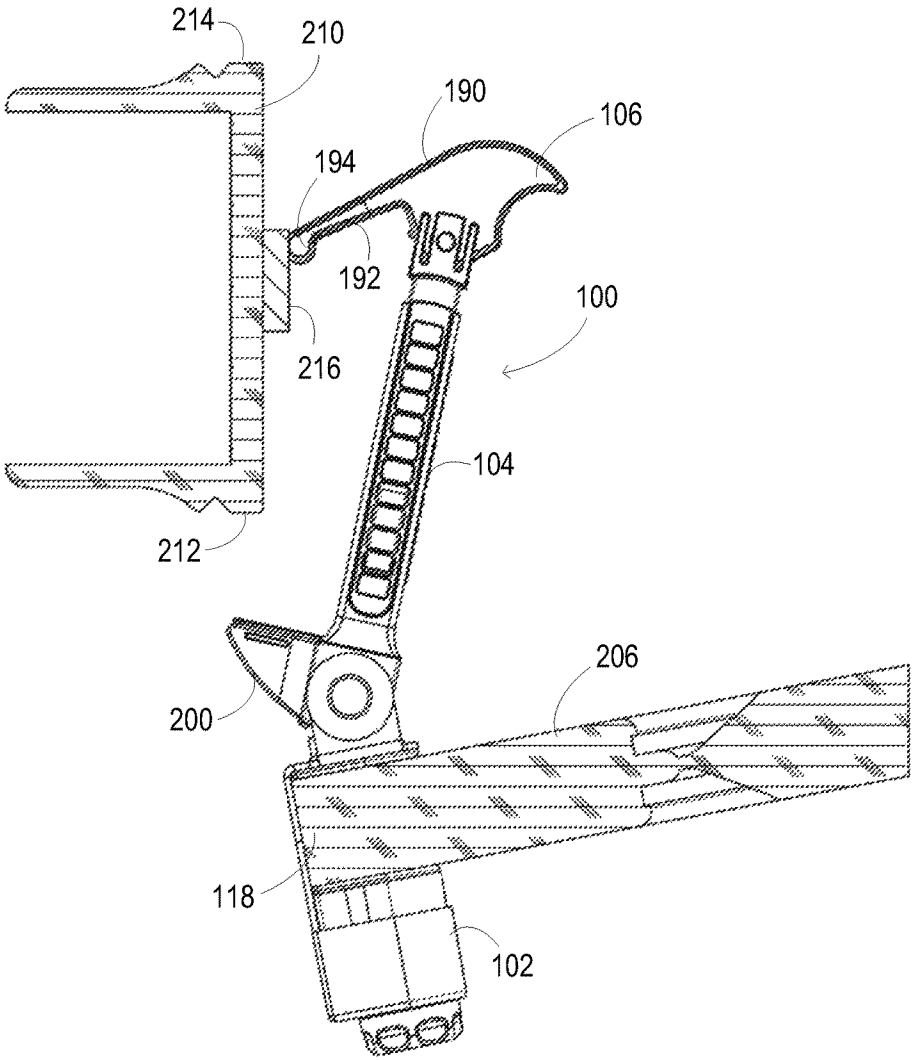
FIG. 6 is a top view of the portable door lock of FIG. 1A mounted to the vertical edge of a door, showing the door frame engagement latch of the portable door lock in a door frame gliding position.

Referring to FIG. 6, elongated and curved distal face 190 can be particularly helpful in promoting smooth travel as door frame engagement latch 106 travels across door stop 216 of door frame 210. As shown, door stop 216 projects from door frame 210 to impede door 206 from rotating past its closed position. In some embodiments, elongated and curved distal face 190 can be padded (e.g., with rubber or foam) and/or coated with a soft material to reduce or eliminate any potential damage to door frame 210 and/or door stop 216. Alternatively, or in addition, door frame engagement latch 106 may be at least partially made of a soft material to reduce or eliminate any potential damage to door frame 210 caused from contact with elongated and curved distal face 190. In other embodiments, neither distal face 190 nor door frame engagement latch 106 includes padding or a soft coating.

Referring again to FIG. 5B, deflection arm 104 is shown in a deflected position. As compared to FIG. 5A, contact between door frame engagement latch 106 and door frame 210 has caused deflection arm 104 to rotate (i.e., deflect) from the biased position to the deflected position. Rotation of deflection arm 104 from the biased position to the deflected position can act to absorb at least a portion of the impact between door frame engagement latch 106 and door frame 210. Accordingly, the rotation of deflection arm 104 can facilitate smooth travel of door frame engagement latch 106 across door frame 210 as door 206 continues to rotate toward its closed position.

FIG. 5C shows portable door lock 100 after completion of the door locking process. Door frame engagement latch 106 has returned to the door frame latching position. Once door frame engagement latch 106 has traversed door frame 210, latch torsion spring 182 (described above with reference to FIG. 1E) acts to rotate door frame engagement latch 106 from the door frame gliding position to the door frame latching position. As shown, finger portion 192 of door frame engagement latch 106 engages distal frame side 214. This engagement can restrict door 206 from being rotated back toward an opened position.

Comparing FIG. 5C to FIG. 5B shows that deflection arm 104 has partially returned to its biased position. Once door frame engagement latch 106 traverses distal frame side 214, arm torsion spring 152 (described above with reference to FIG. 1E) exerts a force that causes deflection arm 104 to rotate toward its biased position. In some cases, deflection arm 104 may return all the way back to its biased position once door frame engagement latch 106 reaches distal frame side 214. The biasing of deflection arm 104 toward the biased position can help maintain the engagement between rounded retaining head 194 and distal frame side 214. That is, deflection arm 104 may supply a holding force that improves the strength of the connection between rounded retaining head 194 and distal frame side 214.

Figure 7:
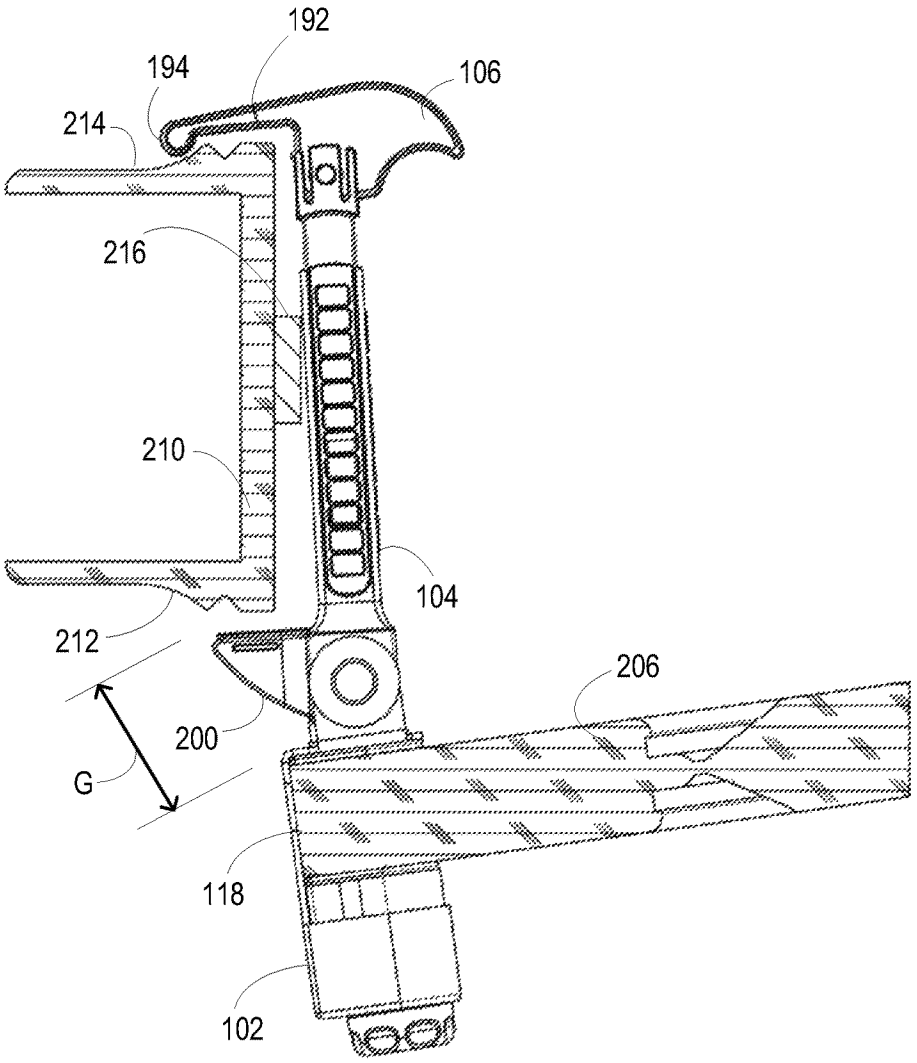
FIG. 7 is a top view of the portable door lock of FIG. 1A mounted to the vertical edge of a door, showing the door frame engagement latch of the portable door lock in a door frame latching position.

Referring to FIG. 7 finger portion 192 and rounded retaining head 194 are shown engaged with distal frame side 214. The illustrated configuration of finger portion 192 and rounded retaining head 194 can provide door frame engagement latch 106 with the versatility to engage with various types of door frames 210 (e.g., different shapes and sizes of door molding). Although door frame engagement latch 106 is shown engaged with distal frame side 214 in FIGS. 5C and 7, its configuration also allows it to engage with door stop 216. That is, rounded retaining head 194 can engage the distal side of door stop 216 to look door 206 (i.e., prevent door rotation toward an open position). In applications where the door is attached to a wall instead of a door frame, finger portion 192 of door frame engagement latch 106 can engage with the distal side of a wall to lock the door. The illustrated configuration of door frame engagement latch 106 allows portable door lock 100 to be compatible in a wide variety of applications.

Referring still to FIG. 7, door frame bumper 200 extends laterally outboard of door mount 102. Such a configuration prevents it from passing proximal frame side 212 during the door locking process. Door frame bumper 200 can obstruct attempts to fully close door 206 through contact with proximal frame side 212. As shown in FIGS. 5C and 7, door frame bumper 200 acts to keep a gap G between vertical door edge 118 and proximal frame side 212. That is, door frame bumper 200 can keep door 206 partially open while it remains locked by door frame engagement latch 106. Gap G between vertical door edge 118 and proximal frame side 212 can allow air to circulate between rooms. The gap may also allow parents, guardians, and pet owners to communicate easier with children and/or pets that are in a locked area.

Door frame bumper 200 may also act to reduce hand and finger injuries by preventing the full closure of door 206. Many hand and finger injuries occur when fingers and/or parts of the hand get pinched between the vertical door edge and door jamb while the door is being closed. Accordingly, door frame bumper 200 can serve as a "pinch guard" that limits such occurrences by stopping rotation of door 206 before it reaches one's fingers or hand.

With continued reference to FIG. 7, door 206 can be unlocked from either proximal frame side 212 or distal frame side 214. That is, door frame engagement latch 106 can be disengaged with distal frame side 214 from either proximal frame side 212 or distal frame side 214 of door frame 210. To unlock door 206 from the distal frame side 214, an external force can be applied to door frame engagement latch 106 and/or deflection arm 104 that causes deflection arm 104 to rotate away from door frame 210. To unlock door 206 from the proximal frame side 212, an external force can be applied to the door frame bumper 200 that causes deflection arm 104 to rotate away from door frame 210. Once deflection arm 104 is rotated a sufficient extent away from door frame 210, finger portion 192 disengages distal frame side 214. Since portable door lock 100 is unlockable from both proximal and distal frame sides 212, 214, one cannot unintentionally lock themselves in regardless of which side of door 206 they are on.

Figure 4B:
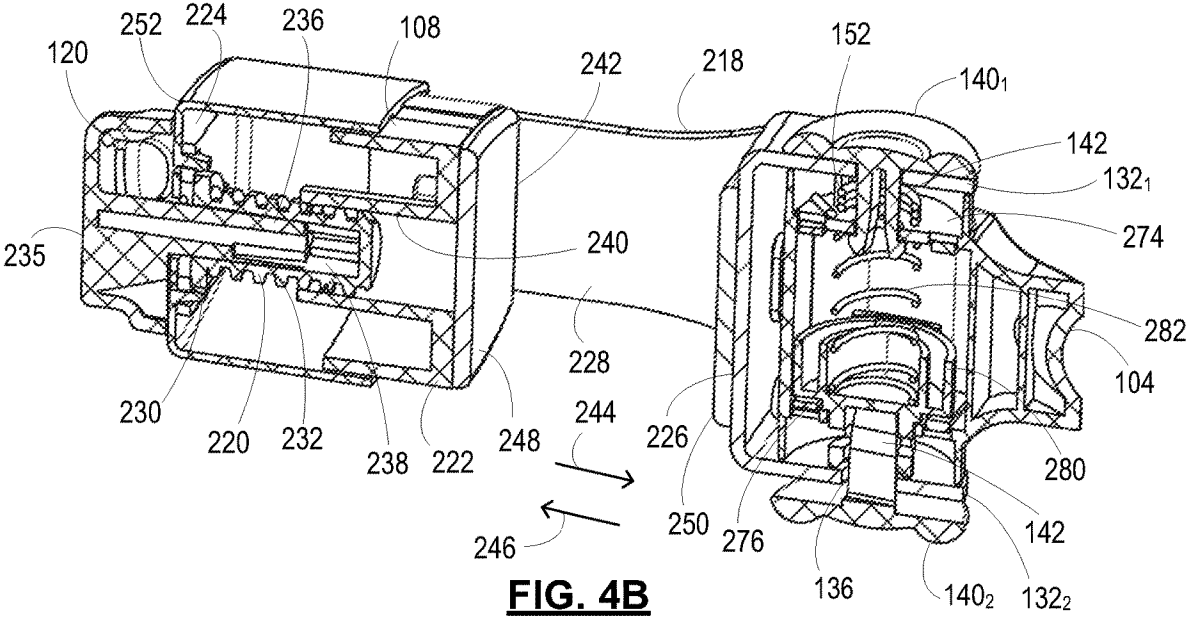
FIG. 4B is a cross-sectional view taken along line 4B-4B of FIG. 4A.

Reference is now made to FIGS. 1E and 4B to continue the earlier description of door mount 102. As shown, door mount 102 includes an adjustable clamp 108. In some embodiments, adjustable clamp 108 may include an adjustment dial 120, a bracket 218, a drive screw 220 and an adjustment block 222.

Bracket 218 has spaced apart and opposed first and second end plates 224, 226 joined by a cross plate 228. Drive screw 220 has a screw head 230 and a threaded portion 232. Adjustment dial 120 is connected to drive screw 220 so that rotation of adjustment dial 120 causes rotation of drive screw 220. Adjustment dial 120 has a dial head 235 and a coupling rod 236. As shown in FIG. 1E, first end plate 224 includes a rod aperture 234 that is sized to receive coupling rod 236 of adjustment dial 120. Rod aperture 234 has a diameter larger than coupling rod 236 and smaller than dial head 235. In this manner, dial head 235 is unable to pass through rod aperture 234.

Referring to FIG. 4B, drive screw 220 has an internal bore 238 that is sized to mate with coupling rod 236 of adjustment dial 120. Coupling rod 236 of adjustment dial 120 can mate with internal bore 238 of drive screw 220 in any suitable manner (e.g., through snap or friction fit, adhesive, etc.). Once mated, drive screw 220 rotates in response to rotation of adjustment dial 120. In the example shown, coupling rod 236 of adjustment dial 120 is snapped with internal bore 238 of drive screw 220 after coupling rod 236 is passed through rod aperture 234 in first end plate 224.

Referring still to FIG. 4B, adjustment block 222 is drivingly engaged with drive screw 220. Adjustment block 222 includes a threaded internal bore 240 that mates with threaded portion 232 of drive screw 220. For clarity of illustration, threads of threaded internal bore 240 are omitted from FIG. 1E. As shown in FIG. 1E, adjustment block 222 has a flat external face 242 that abuts cross plate 228 of bracket 218 when assembled. Engagement between flat external face 242 and cross plate 228 restricts rotational movement of adjustment block 222 relative to cross plate 228 yet allows translational movement (i.e., in door gap tightening and door gap widening directions 244, 246). Accordingly, rotation of drive screw 208 causes translation of adjustment block 222 in door gap tightening or door gap widening directions 244, 246. As described above, drive screw 220 rotates in response to rotation of adjustment dial 120. Thus, as adjustment dial 120 is rotated, adjustment block 222 translates in either door gap tightening direction 244 or door gap widening direction 246 (i.e., depending on whether adjustment dial 120 is rotated clockwise or counterclockwise).

Referring to FIG. 4B, a door's vertical edge can be positioned between adjustment block 222 and second end plate 226. Adjustment dial 120 can then be used to translate adjustment block 222 in door gap tightening direction 244. Adjustment dial 120 can be rotated (e.g., clockwise) until an adequate holding pressure is applied to firmly secure door mount 102 to the door's vertical edge. Adjustment block 222 and second end plate 226 exert opposed holding forces that act to hold door mount 102 to the door's vertical edge. To detach door mount 102 from the door's vertical edge, adjustment dial 120 can be rotated in the opposite direction (e.g., counterclockwise) to translate adjustment block 222 in door gap widening direction 246.

Referring again to FIG. 1E, door mount 102 includes first and second door pads 248, 250. First door pad 248 is connected to adjustment block 222 on the side that faces second plate end 226. Second door pad 250 is connected to second end plate 226 on the side that faces adjustment block 222. Door pads 248, 250 may be connected to adjustment block 222 and second plate end 226 in any suitable fashion (e.g., adhesive, mechanical fasteners, press fit, etc.). Since first and second door pads 248, 250 are positioned between the door adjustment block 222 and second end plate 226, respectively, they may act to protect the door from potential damage. Preferably, door pads 248, 250 are at least partially formed of a soft material, such as, for example, rubber, textured rubber, or foam. Alternatively, or in addition, door pads 248, 250 can increase the amount of friction between the door and door mount 102 and thereby improve the stability of the connection therebetween.

Referring to FIG. 1E, arm stop 204 (described above) projects outwardly from second door pad 250. Since arm stop 204 and second door pad 250 may comprise the same soft material (e.g., rubber), such a configuration may be convenient from a manufacturing perspective. As shown in FIG. 4A, to allow arm stop 204 to extend into the rotational path of deflection arm 104, arm stop 204 of second door pad 250 is passed through an arm stop aperture 205 that is formed in second end plate 226 of bracket 218. In alternative embodiments, arm stop 204 can project outwardly from second arm plate 226.

In some embodiments, bracket 218 is made of sheet metal. When made of sheet metal, bracket 218 can be made slim enough to permit the door to fully close while door mount 102 is secured to the door's vertical edge yet still have an adequate level of strength and rigidity. That is, with a bracket 218 made of sheet metal, cross plate 228 can be slim enough to not obstruct regular door closure yet be durable enough for repeated use without breaking. In alternative embodiments, bracket 218 may be made of other suitable materials (e.g., rigid plastic, carbon fibre, etc.).

Referring to FIG. 1E, upper and lower tabs $\mathbf{132}_1$, $\mathbf{132}_2$ (described above) project outwardly from second arm plate 226 of bracket 218. Since tabs $\mathbf{132}_1$, $\mathbf{132}_2$ and bracket 218 may be made of the same material (e.g., sheet metal), such a configuration may be convenient from a manufacturing perspective.

In the example shown, door mount 102 includes an assembly cover 252. Assembly cover 252 is positioned proximate first end plate 224 of bracket 218. Assembly cover 252 can be secured in various ways (e.g., snap fit, adhesives, mechanical fasteners, etc.). In the example shown, assembly cover 252 is slide over bracket 218 from first end plate 224 prior to coupling adjustment dial 120 to drive screw 220. Accordingly, as shown in FIG. 4B, adjustment dial 120 obstructs removal of assembly cover 252 from bracket 218. As shown in FIGS. 4A-4B, assembly cover 252 can shield internal components (i.e., drive screw 220 and at least a portion of adjustment block 222). In this way, assembly cover 252 can protect these internal components from damage and/or enhance visual appearance. In alternative embodiments, assembly cover 252 may be omitted.

Referring again to FIGS. 1A-1E, deflection arm 104 includes a first arm segment 254 and a second arm segment 256. First arm segment 254 has proximal arm end 126. Second arm segment 256 has distal arm end 128. As shown in FIG. 1A, deflection arm 104 has an arm length 258 from proximal arm end 126 to distal arm end 128. Second arm segment 256 is movable relative to first arm segment 254 to vary arm length 258.

First and second arm segments 254, 256 can be connected in any manner that allows second arm segment 256 to be moved relative to first arm segment 254. As an example, first and second arm segments 254, 256 can be connected via a tongue and groove joint. In this example, one of the first and second arm segments 254, 256 has a longitudinally extending tongue while the other has a corresponding groove that slidably receives the tongue. As another example, first and second arm segments 254, 256 can be connected via a spring-loaded pin. In this example, the pin can be disengaged to allow second arm segment 256 to move relative to first arm segment 254 and then be re-engaged at a desired arm length.

In the example shown, second arm segment 256 is telescopically connected to first arm segment 254. Referring to FIG. 1E, second arm segment 256 has opposed flex tabs 260 located at its proximal end (the lower flex tab is not visible in FIG. 1E but is shown in FIG. 1C). Each flex tab 260 is positioned between a pair of longitudinal slits 262. Longitudinal slits 262 allow each flex tab 260 to flex toward one another (without permanent deformation), thereby allowing second arm segment 256 to be received within first arm segment 254. First arm segment 254 includes a series of opposed tab openings 264 (lower tab openings are not visible in FIG. 1E). Each tab opening 264 is sized to accept a corresponding flex tab 260 of second arm segment 256. When aligned, upper and lower flex tabs 260 pop into corresponding upper and lower tab openings 264 due to their bias toward an unflexed position. To adjust arm length 258, opposed flex tabs 260 are first pressed toward each other to release them from corresponding tab openings 264 and then re-engaged with another pair of tab openings 264 that provides the desired arm length 258.

First arm segment 254 includes eight pairs of opposed tab openings 264 distributed in a regular interval. Accordingly, in the example shown, deflection arm 102 has eight possible arm lengths 258. In alternative embodiments, more or fewer pairs of opposed tab openings 264 may be provided along first arm segment 254. For example, ten pairs of opposed tab openings 264 may be provided along first arm segment 254. All else being equal, the greater the number of opposed tab openings 264, the greater the number of potential arm lengths 258.

Those skilled in the art will appreciate that second arm segment 256 can be telescopically connected to first arm segment 254 in various ways. In an alternative embodiment, it may be first arm segment 254 that includes opposed flex tabs and second arm segment 256 that includes the series of opposed tab openings (i.e., opposite of the example shown). In such an embodiment, first arm segment 254 is receivable within second arm segment 256. In another alternative embodiment, a peg or key may be inserted through aligned openings in first and second arm segments 254, 256 to restrict relative movement. In such an embodiment, removal of the peg or key can allow one of first and second arm segments 254, 256 to move telescopically with respect to the other arm segments 254, 256.

Figure 8:
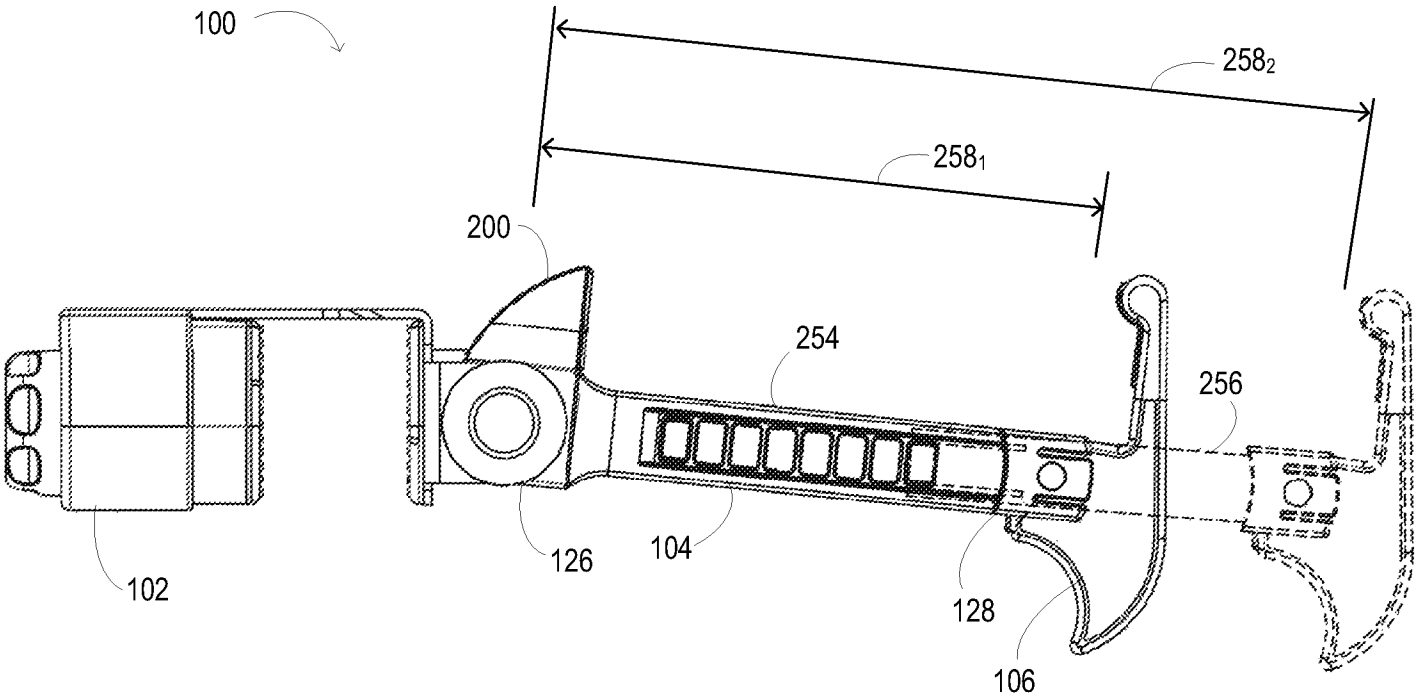
FIG. 8 is a top view of the portable door lock of FIG. 1A, showing a deflection arm of the portable door lock with adjustable arm length.
Figure 9A:
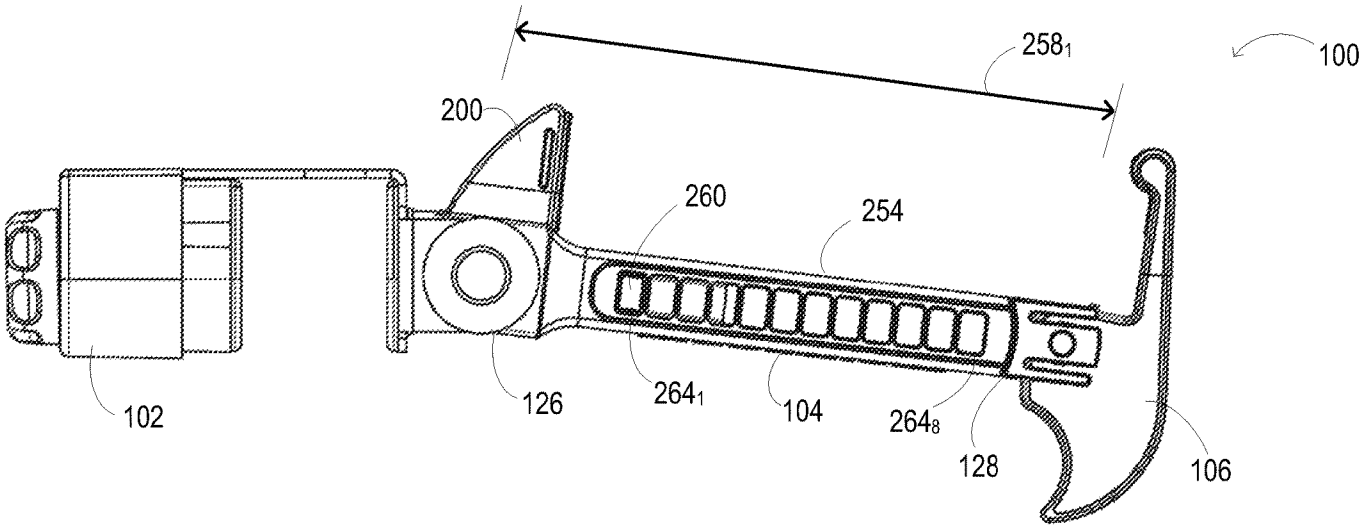
FIGS. 9A-9B are top views of the portable door lock of FIG. 1A, showing the deflection arm at a minimum arm length and a maximum arm length, respectively.
Figure 9B:
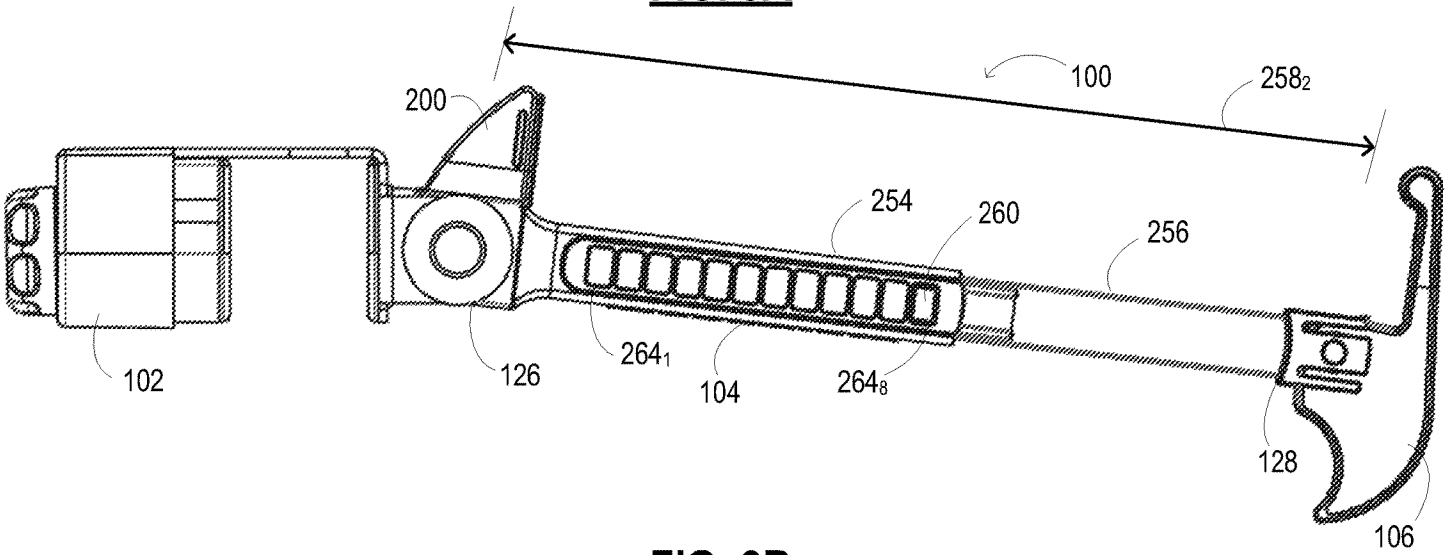

FIG. 8 shows second arm segment 256 moved relative to first arm segment 254 between minimum and maximum arm lengths $\mathbf{258}_1$, $\mathbf{258}_2$. FIGS. 9A and 9B show deflection arm 102 at minimum arm length $\mathbf{258}_1$ and maximum arm length $\mathbf{258}_2$, respectively. Minimum arm length $\mathbf{258}_1$ is achieved when opposed flex tabs 260 of second arm segment 256 are engaged with opposed tab openings $\mathbf{264}_1$ of first arm segment 254 (i.e., the tab openings closest to proximal arm end 126). In some embodiments, minimum arm length $\mathbf{258}_1$ is less than 6 inches (15.2 cm) (e.g., between 3 and 6 inches (7.6 and 15.2 cm)). More preferably, minimum arm length $\mathbf{258}_1$ is about 4.5 inches (11.4 cm). Maximum arm length $\mathbf{258}_2$ is achieved when opposed flex tabs 260 of second arm segment 256 are engaged with opposed tab openings $\mathbf{264}_8$ of first arm segment 254 (i.e., the tab openings closest to distal arm end 128). In some embodiments, maximum arm length $\mathbf{258}_2$ is greater than 6 inches (15.2 cm) (e.g., between 6 and 12 inches (15.2 and 30.5 cm)). More preferably, maximum arm length $\mathbf{258}_2$ is about 8 inches (20.3 cm).

Arm length 258 has a stroke, which is the difference between the minimum and maximum arm lengths $\mathbf{258}_1$, $\mathbf{258}_2$. In different embodiments, the stoke may vary from 0 inches to 12 inches (30.5 cm). In one embodiment, the stroke is 10 inches (25.4 cm). In another embodiment, the stroke is 1 inch (2.54 cm). Preferably, the stroke is at least 2 inches (5 cm). In use, the deflection arm 104 may have a stroke selected to accommodate a subset of door frame thicknesses, and/or type and sizes of door molding, for example. Being able to selectively adjust arm length 258 can provide portable door lock 100 with greater versatility than one without this functionality.

Figure 10:
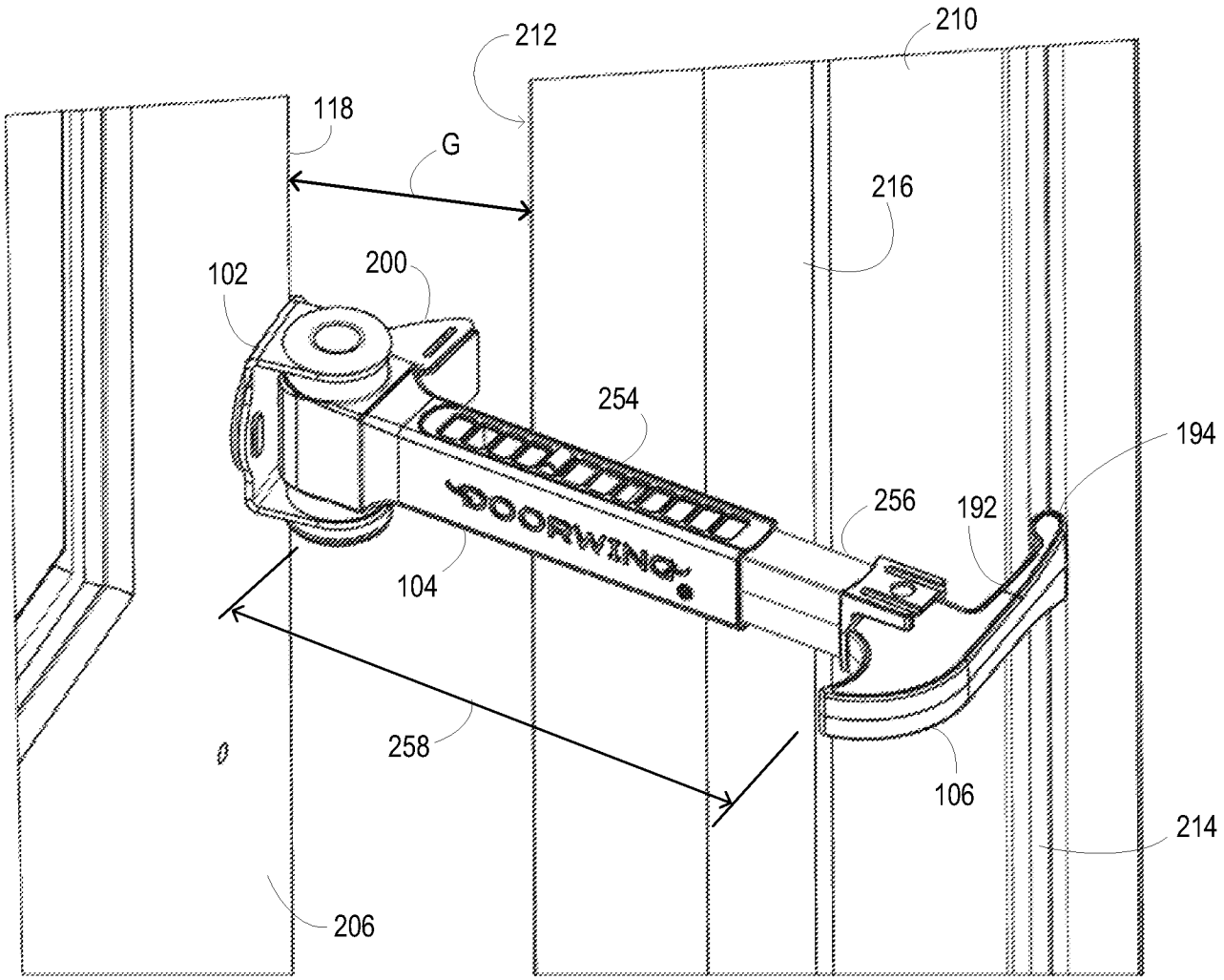
FIG. 10 is a side perspective view of the portable door lock of FIG. 1A being used to maintain a pet passage between the door and door frame.

Referring to FIG. 10, arm length 258 can be varied to adjust gap G between proximal frame side 212 and vertical door edge 118. As compared to FIG. 5C, gap G between proximal frame side 212 and vertical door edge 118 has increased in FIG. 10. As shown in FIG. 10, door frame bumper 200 is spaced apart from proximal frame side 212 because of increased arm length 258. Varying the size of gap G between proximal frame side 212 and vertical door edge 118 can provide one or more advantages. For example, gap G can be sized to allow pets to pass but not larger children. Alternatively, gap G can be sized to allow a small pet (e.g., a cat) to pass but not a larger one (e.g., a dog).

Figure 11A:
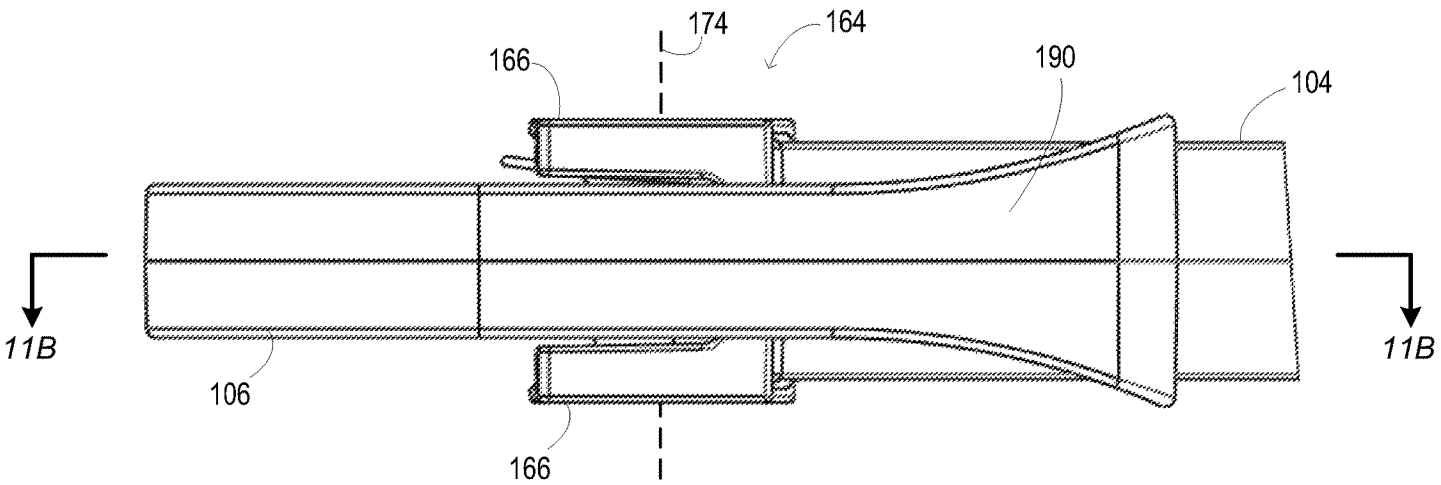
FIG. 11A is a partial rear view of the portable door lock of FIG. 1A, showing the door frame engagement latch in a disabled position.
Figure 11B:
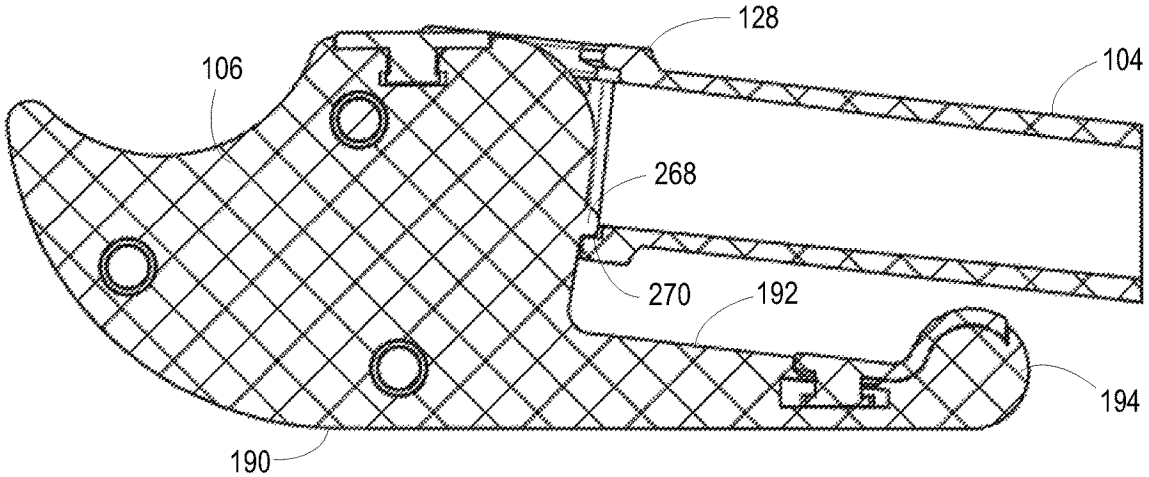
FIG. 11B is a cross-sectional view taken along line 11B-11B in FIG. 11A.

FIGS. 11A-11B show door frame engagement latch 106 in a disabled position. Door frame engagement latch 106 can be positioned in the disabled position in various ways. In the example shown, door frame engagement 106 can be positioned in the disabled position by rotating door frame engagement latch 106 about latch axis 174. Referring to FIG. 2, door frame engagement latch 106 is rotatable along arcuate path 176 from door frame latching position 178, through the plurality of door frame gliding positions $\mathbf{180}_{1\text{-}3}$, to a disabled position 266. In the example shown, door frame engagement latch 106 is rotated about 90 degrees from door frame latching position 178 to disabled position 266. In alternative embodiments, door frame engagement latch 106 may be rotated from 75 to 110 degrees between door frame latching and disabled positions.

Door frame engagement latch 106 can be retained in disabled position 266 in any releasable manner. For example, door frame engagement latch 106 can be releasably retained in disabled position 266 with a loop with a hook and pile fastener, a strap, a clamp, multi-use adhesive, magnets, etc. Alternatively, at least one of deflection arm 104 and door frame engagement latch 106 may have a retaining member that retains door frame engagement latch 106 in disabled position 266 when door frame engagement latch 106 is in the disabled position. Referring to FIG. 11B, in the example shown, door frame engagement latch 106 includes a retaining ridge 268. Retaining ridge 268 snaps with a corresponding lip 270 located at distal arm end 128 to maintain door frame engagement latch 106 in disabled position 266. The application of sufficient force to finger portion 192 (directed away from deflection arm 104) can release (i.e., unsnap) retaining ridge 268 from lip 270.

In alternative embodiments, positioning door frame engagement latch 106 in a disabled position can involve disconnecting door frame engagement latch 106 from deflection arm 104. Referring to FIG. 1E, to remove door frame engagement latch 106, upper and lower latch pivot pins 172 can be disconnected with corresponding tab apertures 168 in tabs 166.

Figure 12A:
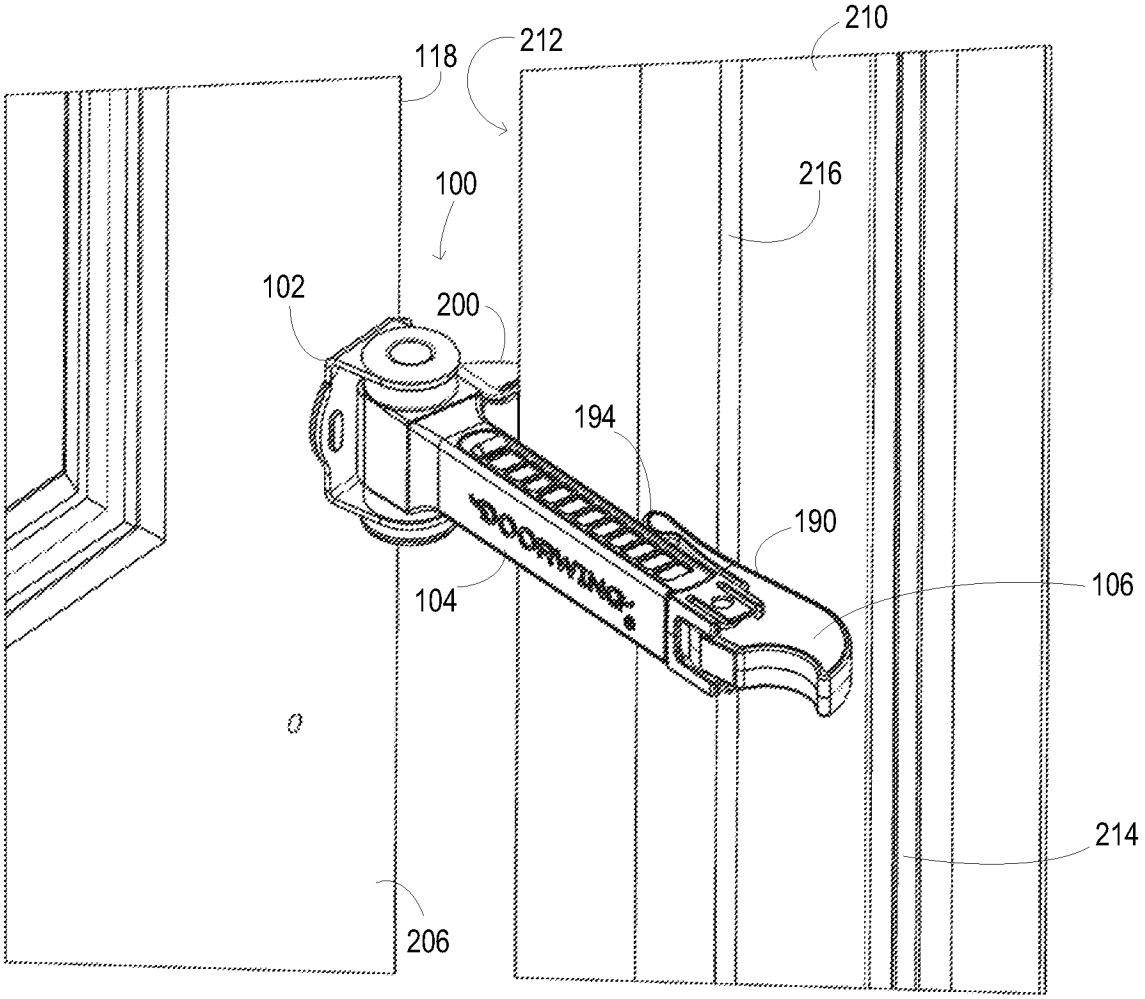
FIGS. 12A-12B are side perspective and top views of the portable door lock of FIG. 1A being used as a pinch guard.
Figure 12B:
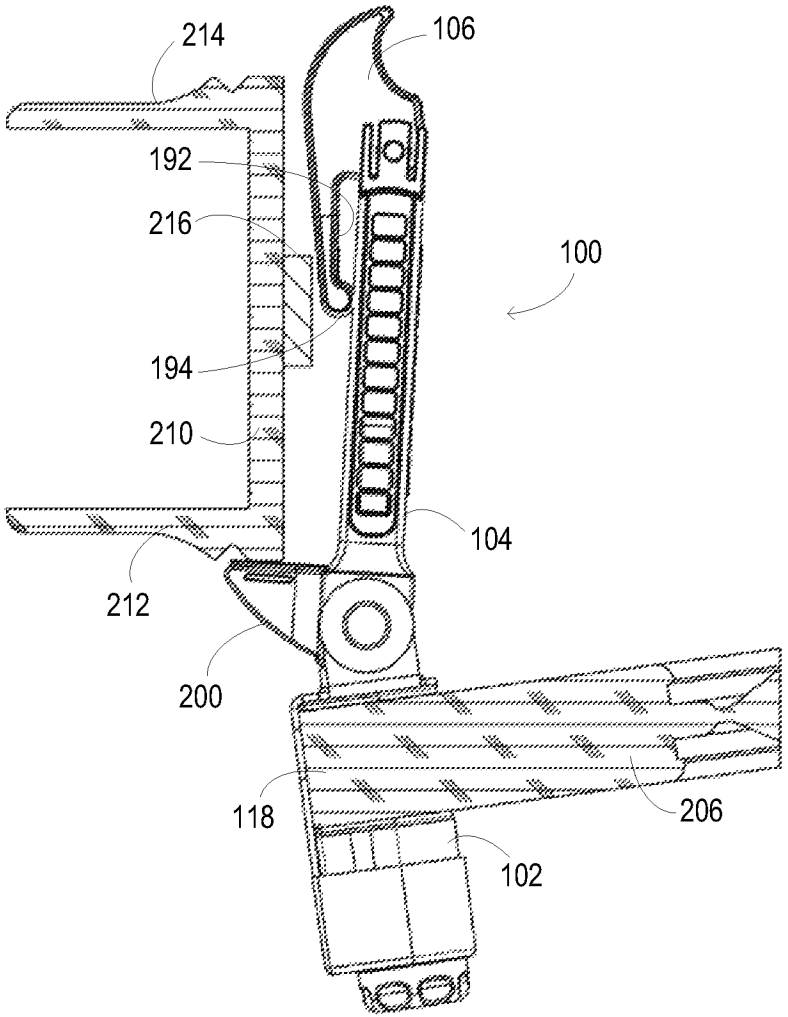

Referring to FIGS. 12A-12B, positioning door frame engagement latch 106 in the disabled position disables its door-locking function. As shown, door 206 is maintained in a slightly open configuration by door frame bumper 200. However, door 206 is free to be opened as desired because door frame engagement latch 106 is not engaged with door frame 210. In such a configuration, portable door lock 100 retains its ability to guard against hand and finger injuries via door frame bumper 200.

As best shown in FIG. 12B, finger portion 192 extends generally parallel to deflection arm 104 when door frame engagement latch 106 is in the disabled position. As used herein, "parallel" means parallel and spaced apart or collinear. In the disabled position, finger portion 192 faces deflection arm 104 to avoid potential engagement with the door frame 210 as door 206 is rotated open or close. When the door frame engagement latch 106 is in the disabled position, elongated and curved distal face 190 allows for smooth travel across door frame 210 (between proximal and distal frame sides 212, 214). As door 206 is rotated with door frame engagement latch 106 in the disabled position, rounded retaining head 194 is unable to grab onto any feature of door frame 210 due to its rounded shape.

Figure 13:
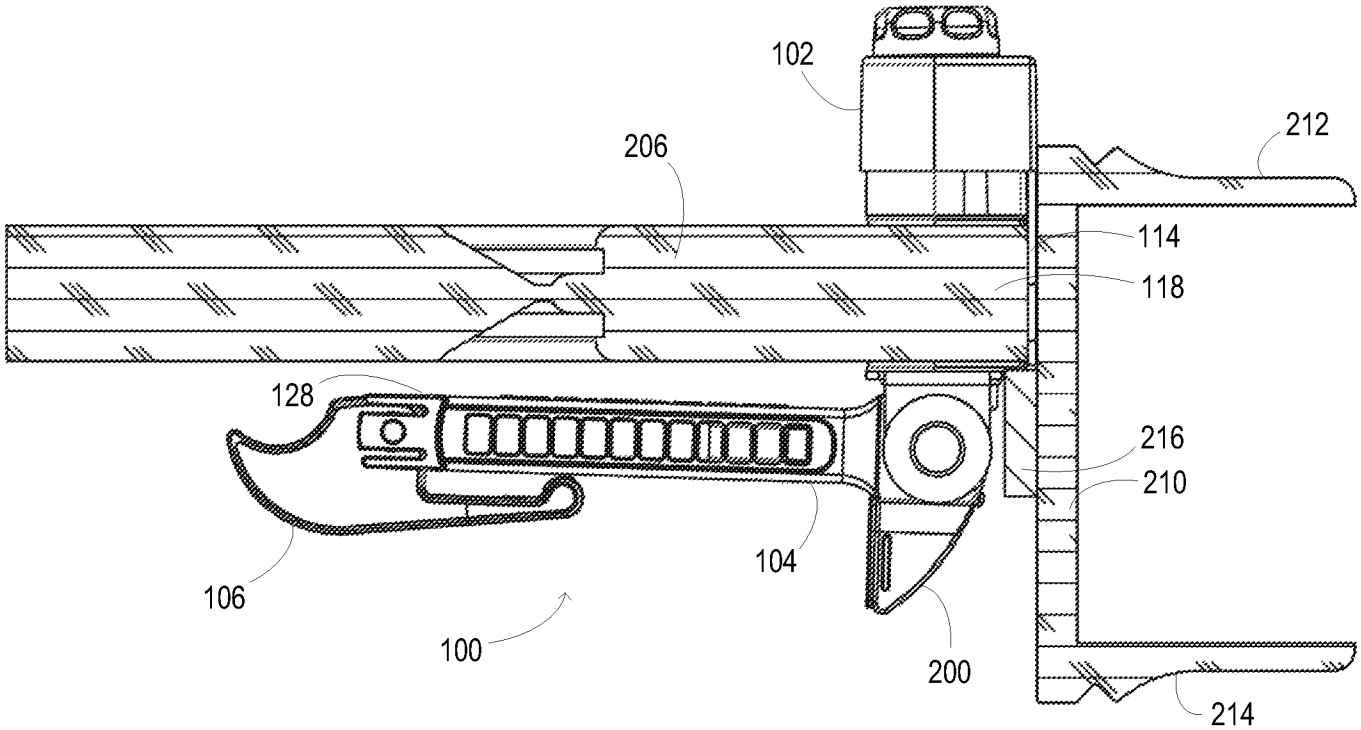
FIG. 13 is a top view of the portable door lock of FIG. 1A mounted to the vertical edge of a closed door, showing the deflection arm in the stowed position.

FIG. 13 shows deflection arm 104 in a stowed position. Deflection arm 104 can be positioned in the disabled position by rotating deflection arm 104 about deflection axis 144 (FIG. 1A). Deflection arm 104 can be moved to the stowed position when both hand/injury protection (via door frame bumper 200) and door locking (via door frame engagement latch 106) are not needed. Effectively, moving deflection arm 104 to the stowed position allows door 206 to open and close as normal while portable door lock 100 remains mounted to door 206. As described above, planar jamb member 114 of door mount 102 does not obstruct full closure of door 206. As shown, planar jamb member 114 is thin enough that it can be sandwiched between vertical door edge 118 and door frame 210 while door 206 is fully closed.

Figure 14:
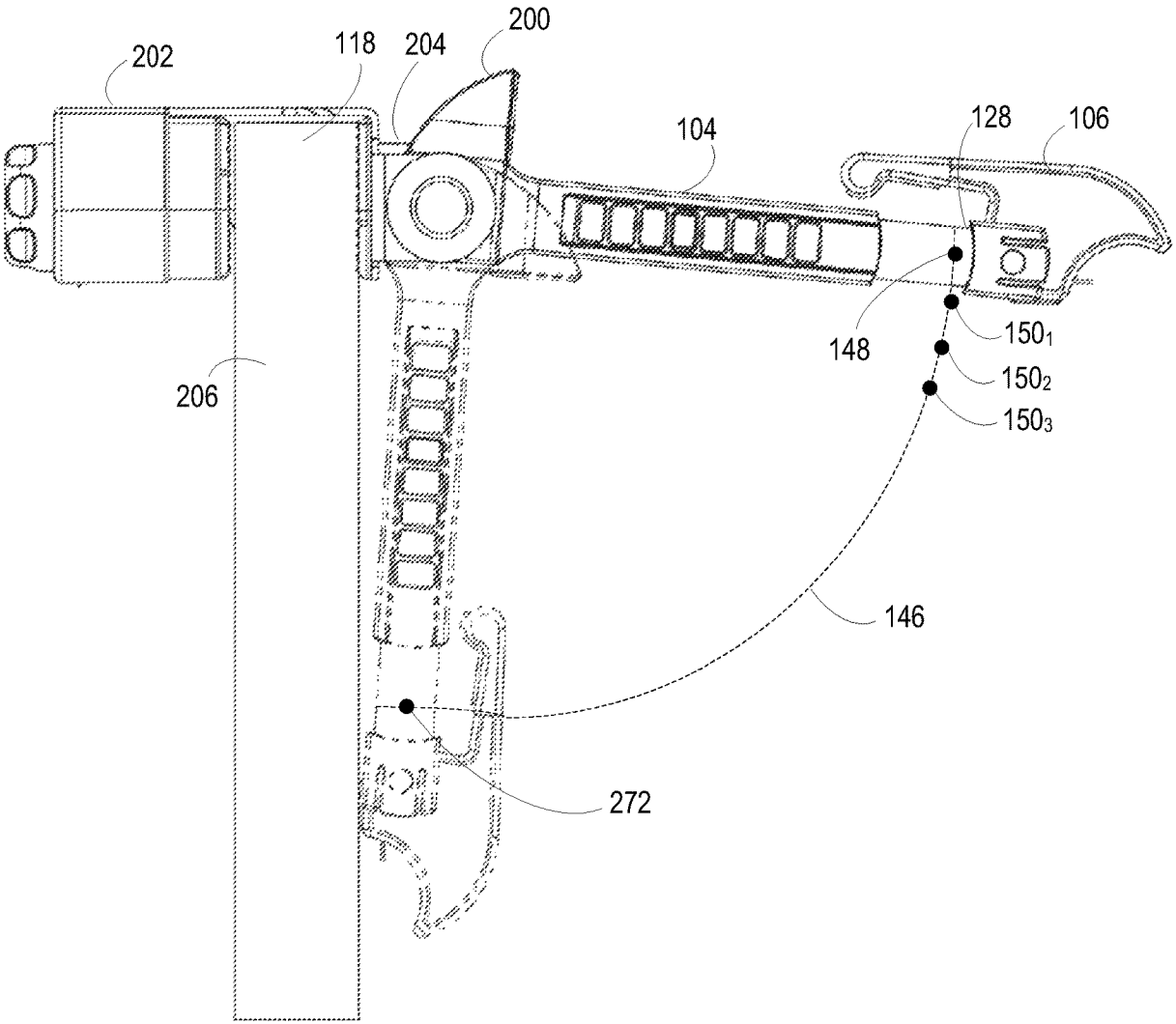
FIG. 14 is a top view of the portable door lock of FIG. 1A, showing the deflection arm moved between biased and stowed positions.

Referring to FIG. 14, deflection arm 104 is rotatable along arcuate path 146 from biased position 148, through the plurality of deflected positions $\mathbf{150}_{1\text{-}3}$, to a stowed position 272. In the example shown, deflection arm 104 is rotated about 90 degrees from biased position 148 to stowed position 272. In alternative embodiments, deflection arm 104 may be rotated from 75 to 110 degrees between biased and stowed positions. Distal arm end 128 is brought nearer to door 206 when deflection arm 104 is rotated toward stowed position 272. Preferably, deflection arm 104 extends between generally parallel (within 0 to 15 degrees) to door 206 when in stowed position 272. As shown, one may elect to position deflection arm 104 in the stowed position and door frame engagement latch 106 in the disabled position at the same time. This arrangement keeps deflection arm 104 and door frame engagement latch 106 out of the way when portable door lock 100 is not in use.

Deflection arm 104 can be retained in stowed position 272 in any releasable manner. For example, deflection arm 104 can be releasably retained in stowed position 272 with a loop with a hook and pile fastener, a strap, a clamp, multi-use adhesive, magnets, etc. Alternatively, or in addition, at least one of deflection arm 104 and door mount 102 may have a retainer that retains deflection arm 104 in the stowed position when deflection arm 104 is in the stowed position.

Figure 15:
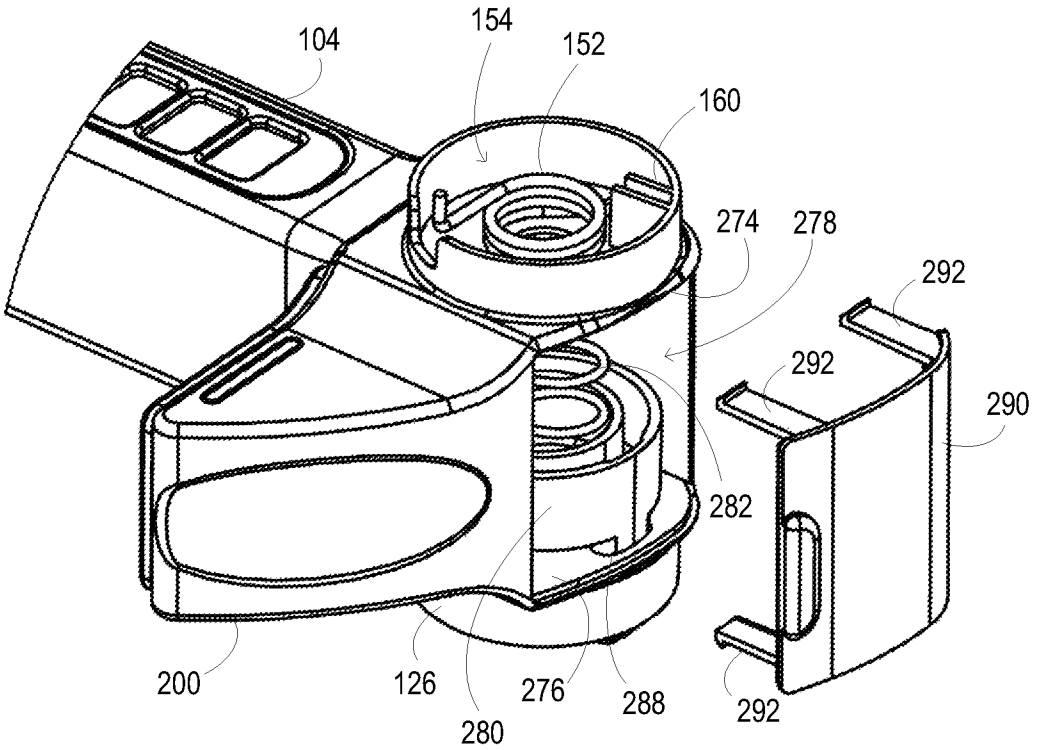
FIG. 15 is a partial side perspective view of a deflection arm that may be used with the portable door lock of FIG. 1A, showing a cavity lid detached from the deflection arm.

Referring to FIG. 15, proximal arm end 126 includes an upper wall 274, a lower wall 276, and an internal cavity 278 that is defined in part by upper and lower walls 274, 276. As shown, a plunger lock 280 and a coil spring 282 are located within internal cavity 278. Plunger lock 280 is positioned against lower wall 276. Coil spring 282 is positioned so that it extends between plunger lock 280 and upper wall 274.

With reference to FIGS. 1E and 15, plunger lock 280 includes a pair of spaced apart alignment tabs 284. Lower tab $\mathbf{132}_2$ of bracket 218 includes a tab aperture 136 located between a pair of tab registration apertures 286. Lower wall 276 also includes a rod aperture (not visible) located between a pair of tab registration apertures 288 (only one of which is visible in FIG. 15) Although not fully visible in FIGS. 1E and 15, the rod aperture and tab registration apertures 288 in lower wall 276 are similar in size and shape to tab aperture 136 and tab registration apertures 286 in lower tab $\mathbf{132}_2$. Tab registration apertures 288 in lower wall 276 correspond with tab registration apertures 286 in lower tab $132_2$ when deflection arm 104 is in stowed position 272 (FIG. 14).

Referring to FIG. 4B, engagement rod 142 of lower joint cap $140_2$ passes through tab aperture 136 in lower tab $132_2$ and the rod aperture in lower wall 276 before attaching to plunger lock 280. As deflection arm 104 rotates so to do tab registration apertures 288 in lower wall 276. When deflection arm 104 is in the stowed position, alignment tabs 284 of plunger lock 280 align with corresponding tab registration apertures 286 in lower tab $132_2$ and tab registration apertures 288 in lower wall 276. In this aligned arrangement, tension in coil spring 282 causes alignment tabs 284 of plunger lock 280 to pass through corresponding tab registration apertures 288 in lower wall 276 and tab registration apertures 286 in lower tab $132_2$ and. FIG. 15 shows alignment tab 284 of plunger lock 280 passed through tab registration aperture 288 in lower wall 276.

With alignment tabs 284 of plunger lock 280 received within corresponding tab registration apertures 286 in lower tab $132_2$ and tab registration apertures 288 in lower wall 276, deflection arm 104 is retained in the stowed position. That is, arm torsion spring 152 is unable to return deflection arm 104 to its biased position. Deflection arm 104 cannot be rotated relative door mount 102 until alignment tabs 284 of plunger lock 280 are removed from tab registration apertures 286 in lower tab $132_2$.

Referring to FIG. 4B, when deflection arm 104 is in the stowed position, the extension of coil spring 282 separates lower joint cap $140_2$ from lower tab $132_2$. Pressing joint cap $140_2$ toward lower tab $132_2$ compresses coil spring 282 and moves plunger lock 280 toward upper wall 274. In response, alignment tabs 284 of plunger lock 280 disengage tab registration apertures 286 in lower tab $132_2$, thereby permitting rotation of deflection arm 104. In this context, lower joint cap $140_2$ may be characterized as a "release button".

With reference to FIGS. 1E and 15, deflection arm 104 includes a cavity lid 290. Cavity lid 290 is secured to proximal arm end 126 to close internal cavity 278. In the example shown, cavity lid 290 includes flex clips 292 that mate with corresponding grooves (not visible) located in the upper and lower walls 274, 276 to secure cavity lid 290 to proximal arm end 126. Various ways of securing cavity lid 290 to proximal arm end 126 are possible.

Reference is now made to FIGS. 16A-16E. FIGS. 16A-16E show a portable door lock 100 in accordance with another embodiment. Portable door lock 100 shown in FIGS. 16A-16E is similar to portable door lock 100 shown in FIGS. 1A-1E, except for differences in the configuration of door frame engagement latch 106 and the manner in which door frame engagement latch 106 is connected to deflection arm 104. Unless otherwise noted, like-numbered elements (i.e., elements having the same reference numerals) have similar structure and/or perform similar function as those in portable door lock 100 shown in FIGS. 1A-1E.

Figure 16A:
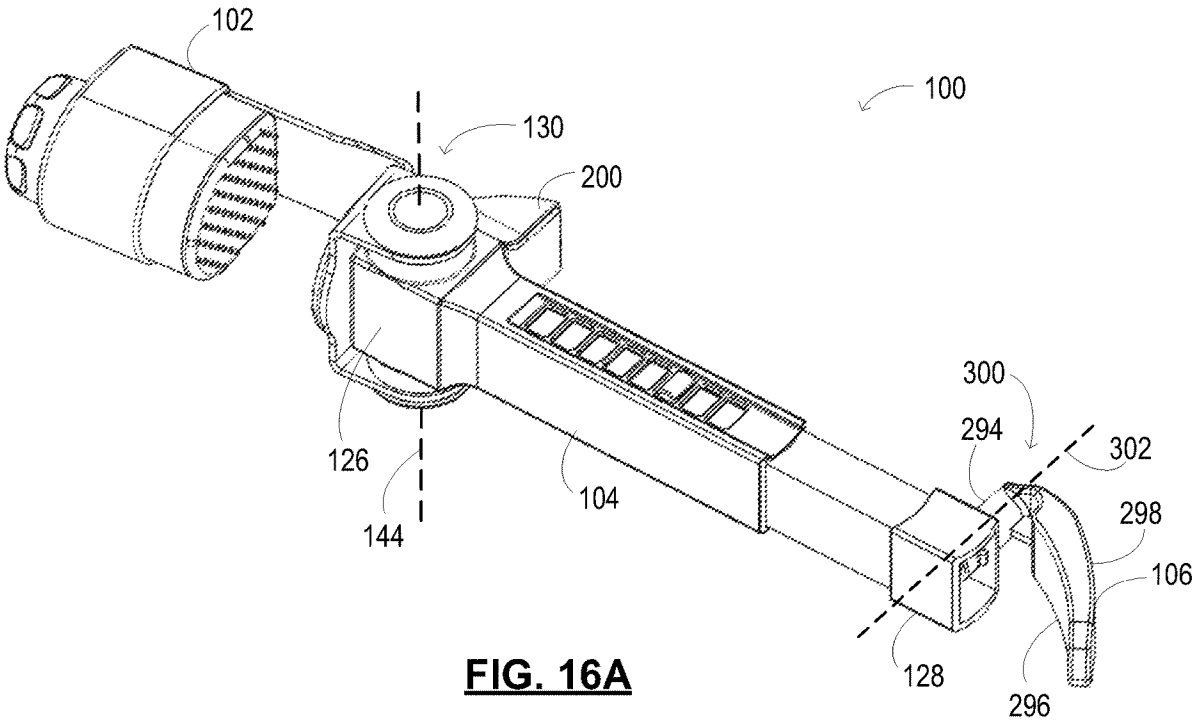
FIG. 16A is a front perspective view of a portable door lock, in accordance with a second embodiment.
Figure 16B:
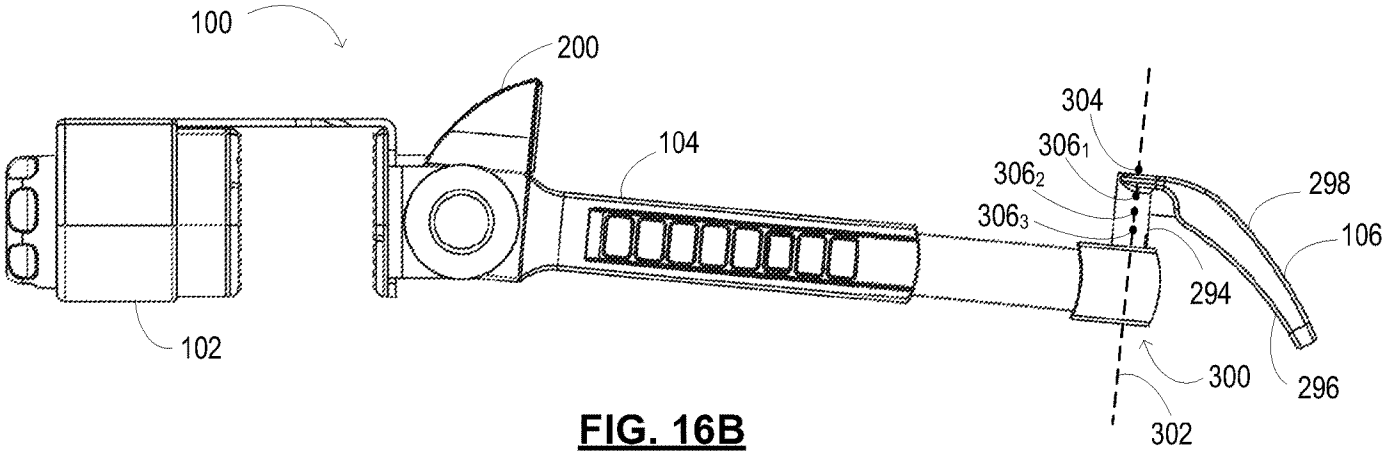
FIGS. 16B-16D are top, front and side views of the portable door lock of FIG. 16A, respectively.
Figure 16C:
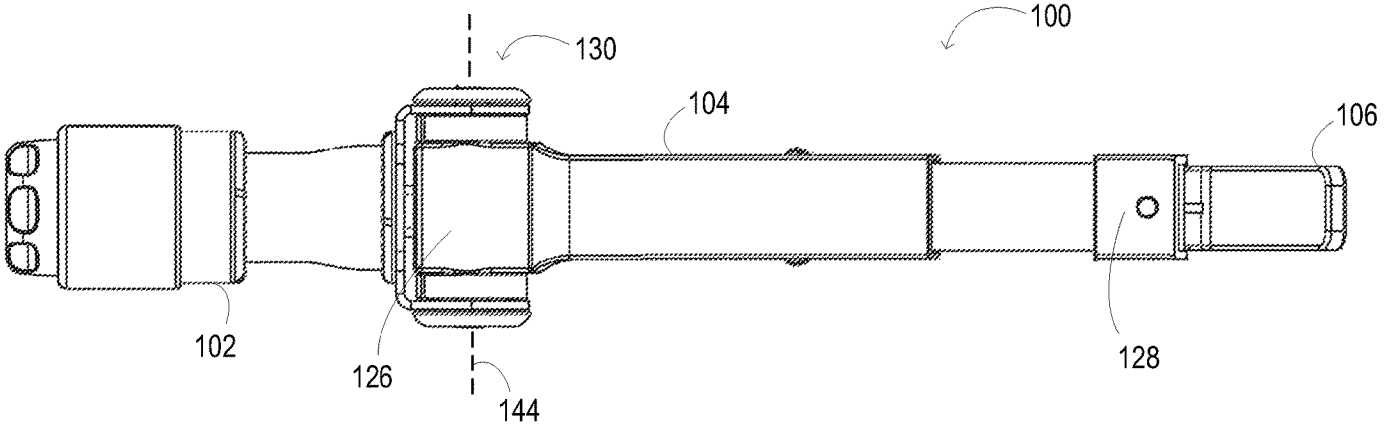
Figure 16D:
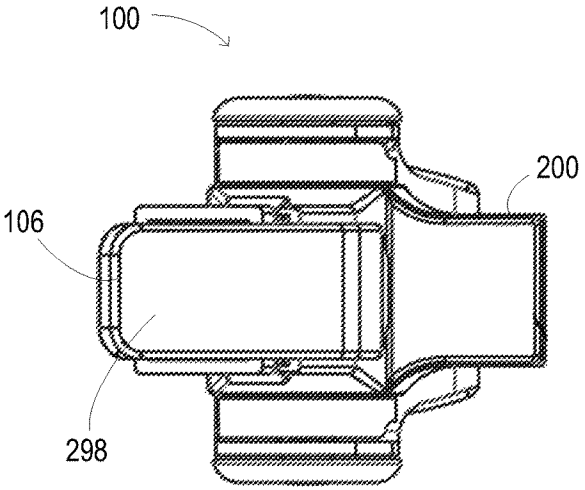

Referring to FIGS. 16A-16B, door frame engagement latch 106 has a plunger portion 294, a hook portion 296 and an elongated and curved distal face 298. As shown, plunger portion 294 extends perpendicular to deflection arm 104. In this arrangement, plunger portion 294 may engage (i.e., grab onto) the door frame to lock the door in a partially open position. Elongated and curved distal edge 298 of door frame engagement latch 106 can allow door frame engagement latch 106 to slide smoothly across the door jamb during a locking process.

Door frame engagement latch 106 is movably connected to deflection arm 104 at a translation joint 300. As described below, features of both door frame engagement latch 106 and distal arm end 128 cooperate to provide translation joint 300. Referring to FIG. 16B, translation joint 300 has a translation axis 302 along which door frame engagement latch 106 is movable relative to deflection arm 104. As shown, translation axis 302 extends perpendicular to deflection arm 104. Translation joint 300 allows (e.g., constrains) deflection arm 104 to move along translation axis 302 between a door frame latching position 304 and a plurality of door frame gliding positions 306, e.g., $306_1$, $306_2$ and $306_3$.

In use, door frame engagement latch 106 moves (i.e., translates) along translation axis 302 from door frame latching position 304 to one of door frame gliding positions 306 in response to contact with the door frame. The extent to which door frame engagement latch 106 moves between door frame latching and door frame gliding positions 304, 306 depends on various factors, such as, for example, the length of deflection arm 104 and type of the door frame (e.g., molding shape). For example, door frame engagement latch 106 may translate up to 2 inches (5.08 cm) between biased and deflected positions (e.g., 0.25 to 2 inches (0.63 to 5.08 cm)). In one configuration, door frame engagement latch 106 may translate 0.5 inches (1.27 cm) between door frame latching and door frame gliding positions 304, 306. In another configuration, door frame engagement latch 106 may move 1.5 inches (3.81 cm) between door frame latching and door frame gliding positions 304, 306.

Translation joint 300 includes a latch coil spring 308 (FIG. 16E) that acts to bias door frame engagement latch 106 toward door frame latching position 304. Upon release of a force that has caused door frame engagement latch 106 to move to door frame gliding position 306, latch coil spring 308 acts to return door frame engagement latch 106 to door frame latching position 304. In an alternative embodiment, the biasing of door frame engagement latch 106 can be provided by any biasing means that causes door frame engagement latch 106 to move from door frame gliding position 306 to door frame latching position 304 in the absence of an external force.

Figure 16E:
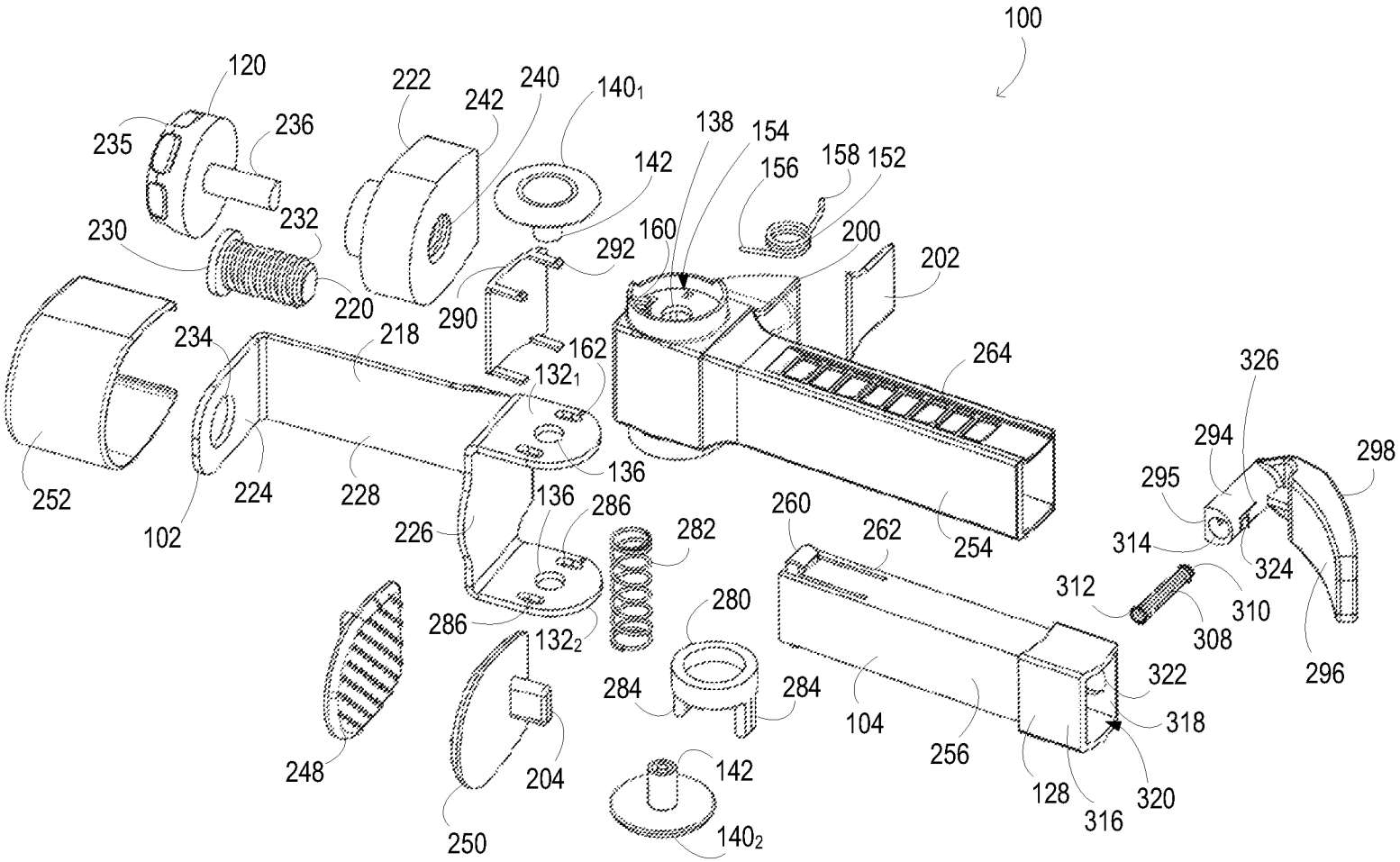
FIG. 16E is an exploded front perspective view of the portable door lock of FIG. 16A.

Referring to FIG. 16E, latch coil spring 308 extends from a spring latch end 310 to a spring arm end 312. Spring latch end 310 is held within a spring recess 314 that is provided in plunger portion 294 of door frame engagement latch 106. Distal arm end 128 includes laterally spaced apart side walls 316, 318 and an internal cavity 320 that is defined in part by side walls 316, 318. Side wall 318 has a spring aperture 322 formed therein. Spring arm end 312 passes through spring aperture 322 and connects with side wall 316 of distal arm end 128. Accordingly, latch coil spring 308 interacts with door frame engagement latch 106 and deflection arm 104 through spring latch end 310 and spring arm end 312, respectively. It is through this interaction that latch coil spring 308 can exert force to bias door frame engagement latch 106 toward door frame latching position 304 (FIG. 16B).

Referring still to FIG. 16E, plunger portion 294 includes opposed retention tabs 324 (only one of which is visible in FIG. 16E). Each retention tab 324 is positioned between a pair of lateral slits 326. Lateral slits 326 allow each retention tab 324 to flex toward one another (without permanent deformation) as plunger portion 294 is passed into internal cavity 320 through spring aperture 322. Once retention tabs 324 pass through spring aperture 322 they expand to their unflexed (i.e., natural) position and act to impede disconnection in the opposite direction.

With continued reference to FIG. 16E, plunger portion 294 of door frame engagement latch 106 is shown having a "D"-shaped cross-section. Although not completely visible in FIG. 16E, spring aperture 322 has a similar shape that corresponds with the "D"-shaped cross-section of plunger portion 294. Accordingly, when plunger portion 294 is received in spring aperture 322, its cross-sectional shape restricts rotation of door frame engagement latch 106 about translation axis 302. By restricting rotation of door frame engagement latch 106, the flat external face 295 of plunger portion 294 can be kept as the region of engagement with the distal side of the door frame, or the distal side of door stop.

Figure 17:
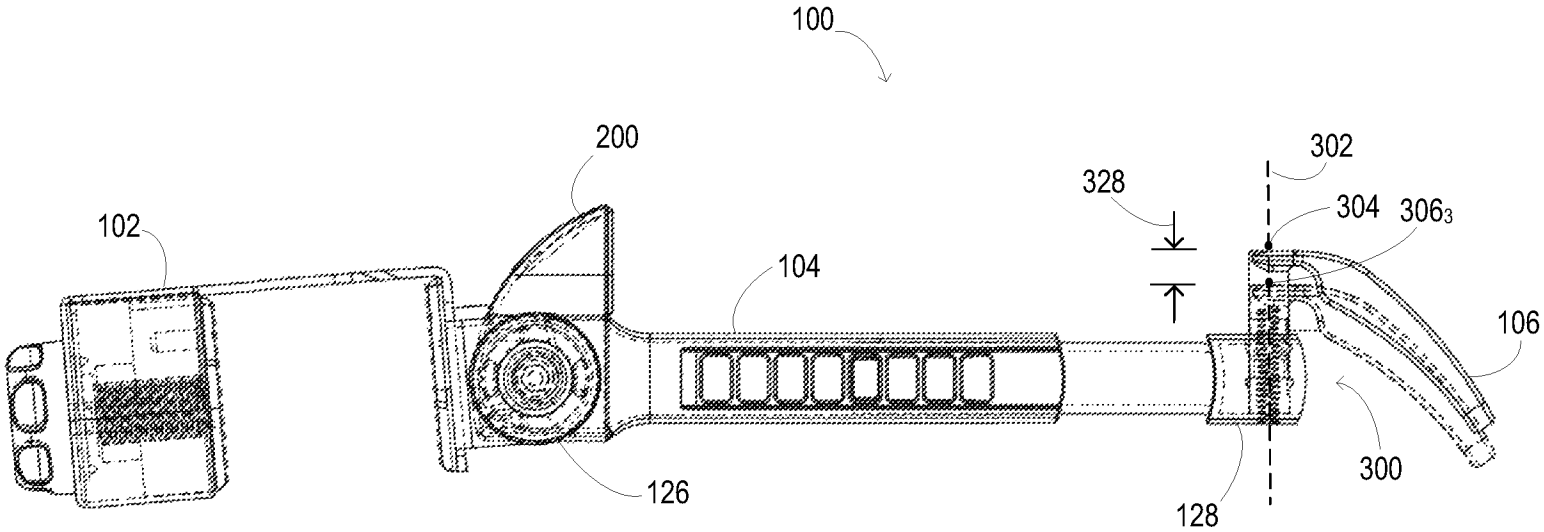
FIG. 17 is a top view of the portable door lock of FIG. 16A, showing a door frame engagement latch of the portable door lock moved between door frame latching and door jamb gliding positions.

FIG. 17 shows door frame engagement latch 106 moved along translation axis 302 between door frame latching position 304 and maximum door frame gliding position 3063. Accordingly, FIG. 17 shows the full extent that door frame engagement latch 106 can translate along translation axis 302. A translation range 328 between door frame latching position 304 and maximum door frame gliding position $\mathbf{306}_3$ can be anywhere between 0 and 2 inches (0 and 5.08 cm). More preferably, translation range 328 is between 0.25 and 1.25 inches (0.64 and 3.18 cm).

Figure 18A:
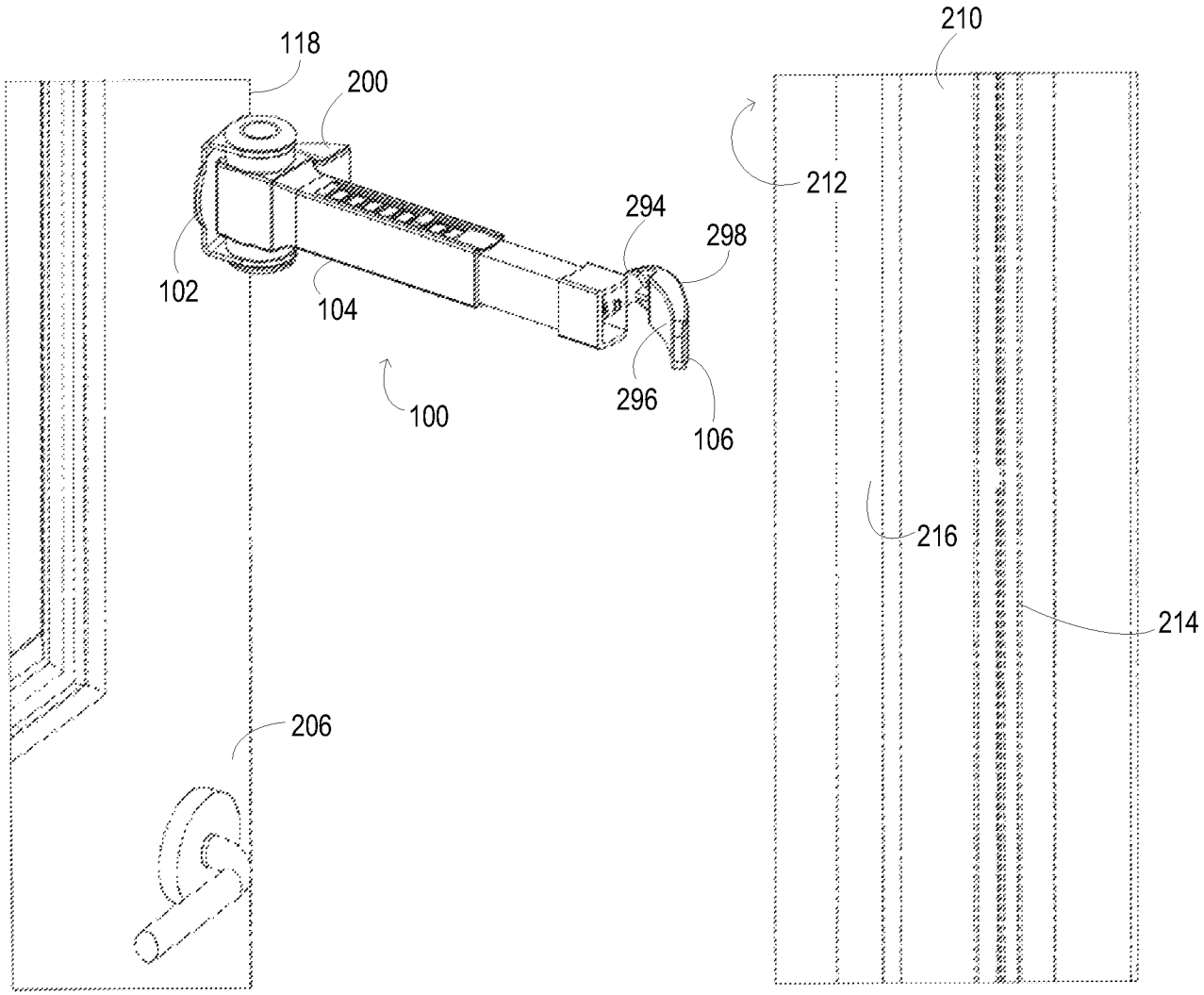
FIGS. 18A-18C are side perspective views illustrating an exemplary door locking process using the portable door lock of FIG. 16A.
Figure 18B:
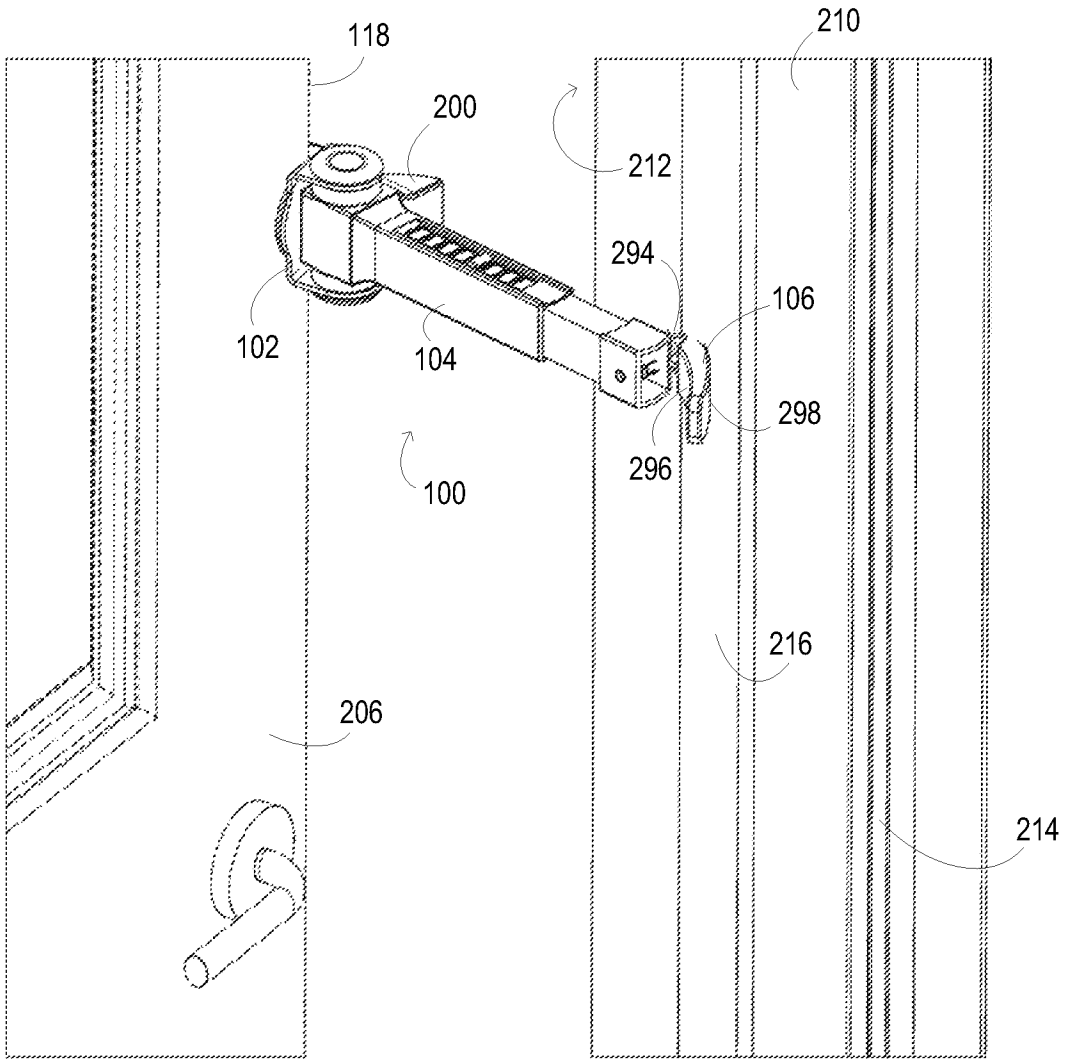
Figure 18C:
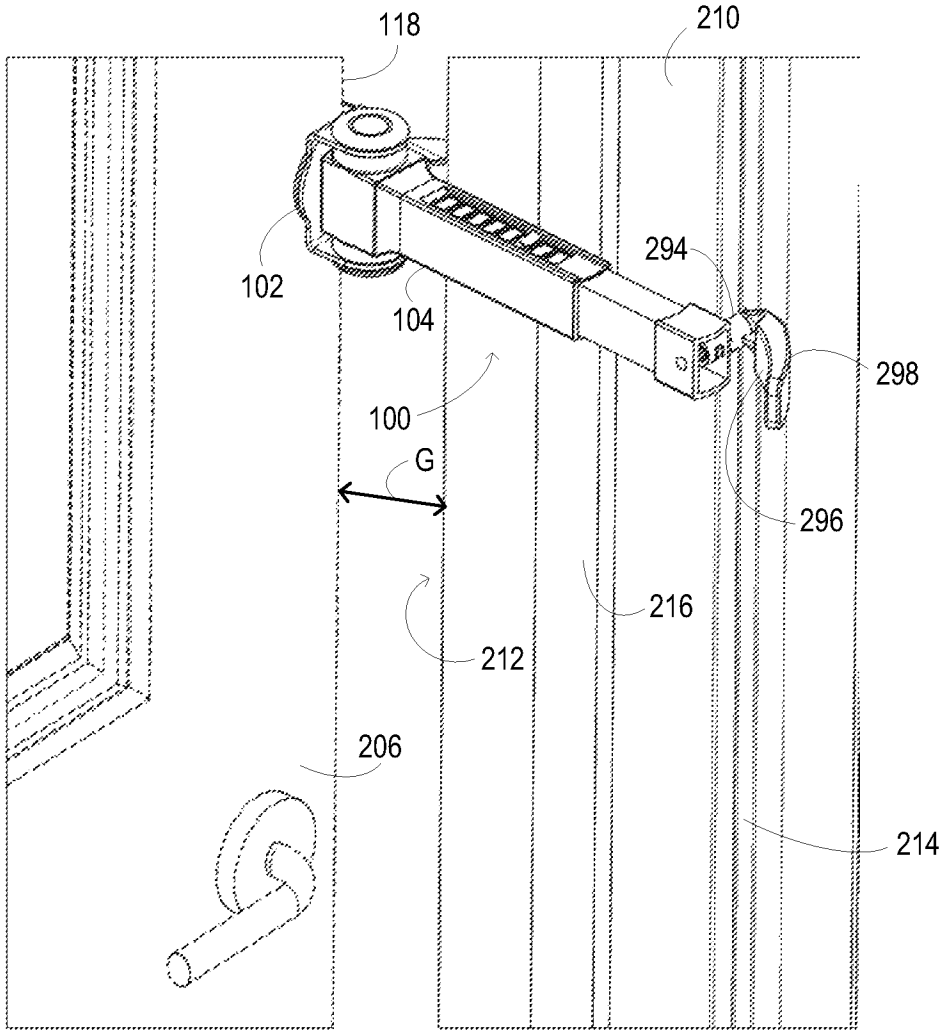
Figure 19A:
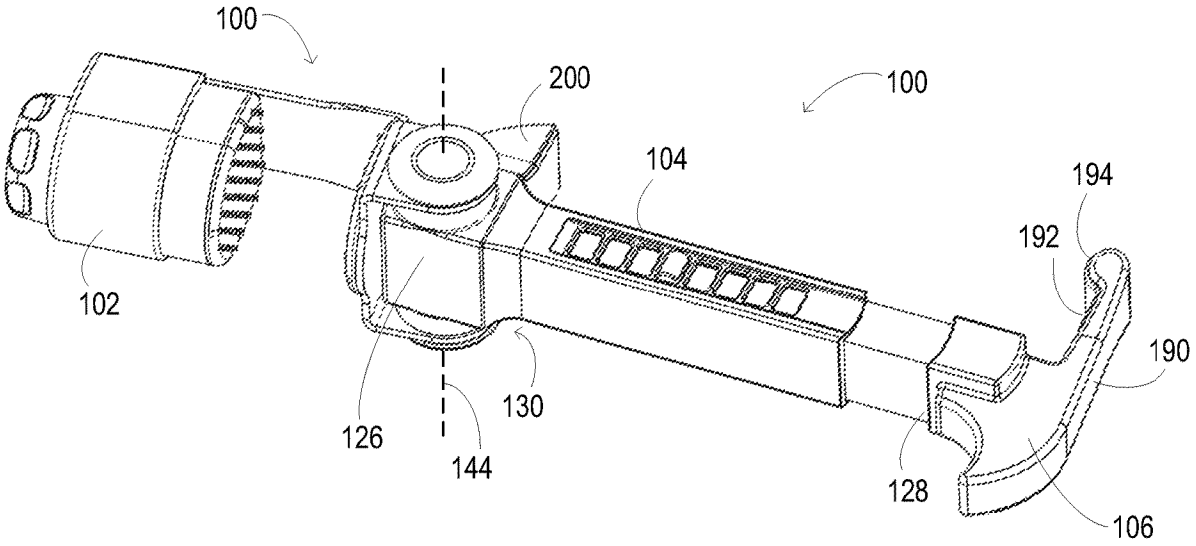
FIG. 19A is a front perspective view of a portable door lock, in accordance with a third embodiment.
Figure 19B:
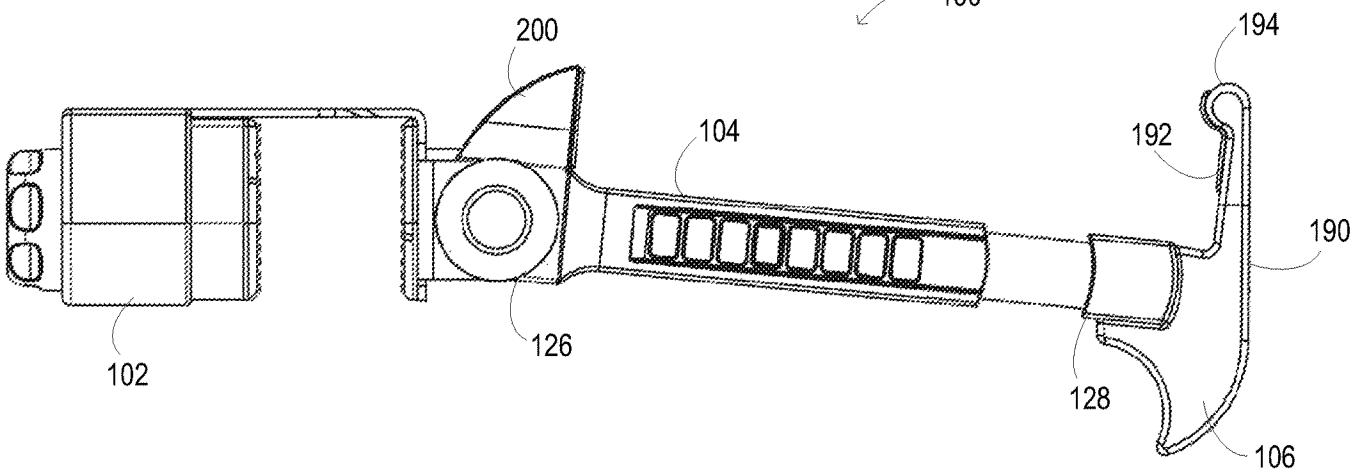
FIGS. 19B-19D are top, front and side views of the portable door lock of FIG. 19A, respectively.
Figure 19C:
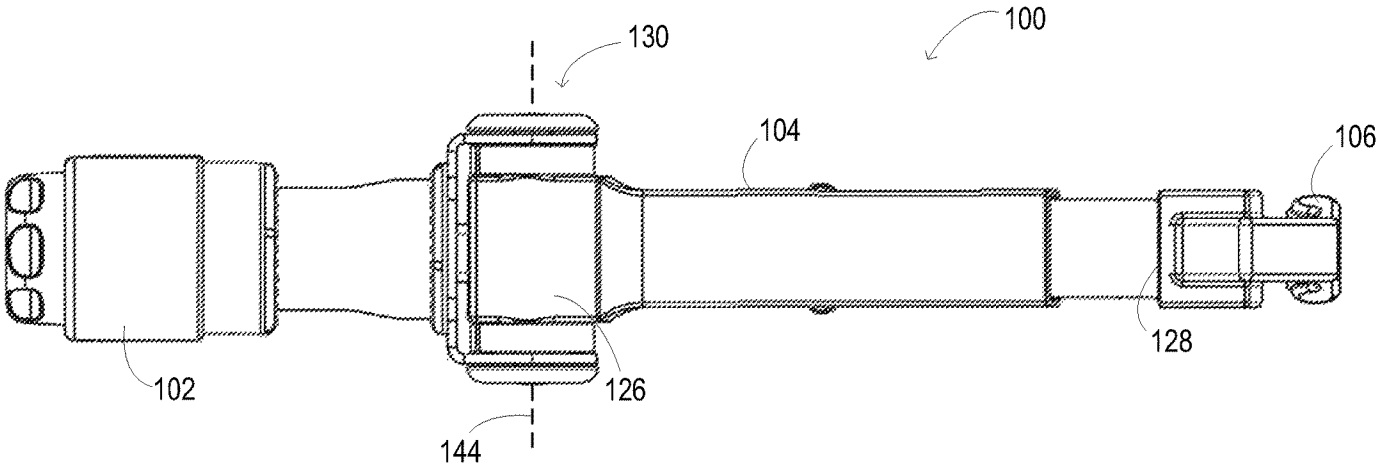
Figure 19D:
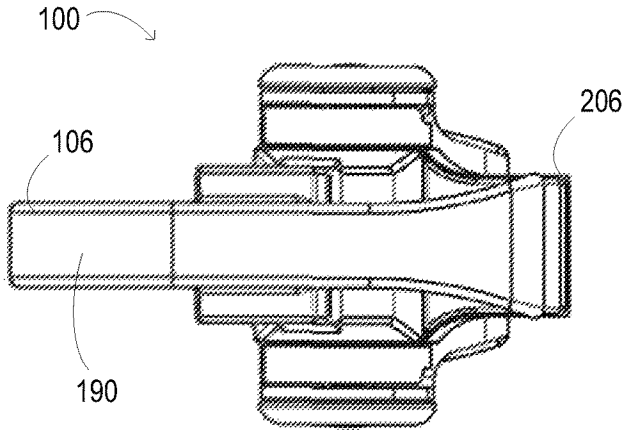
Figure 19E:
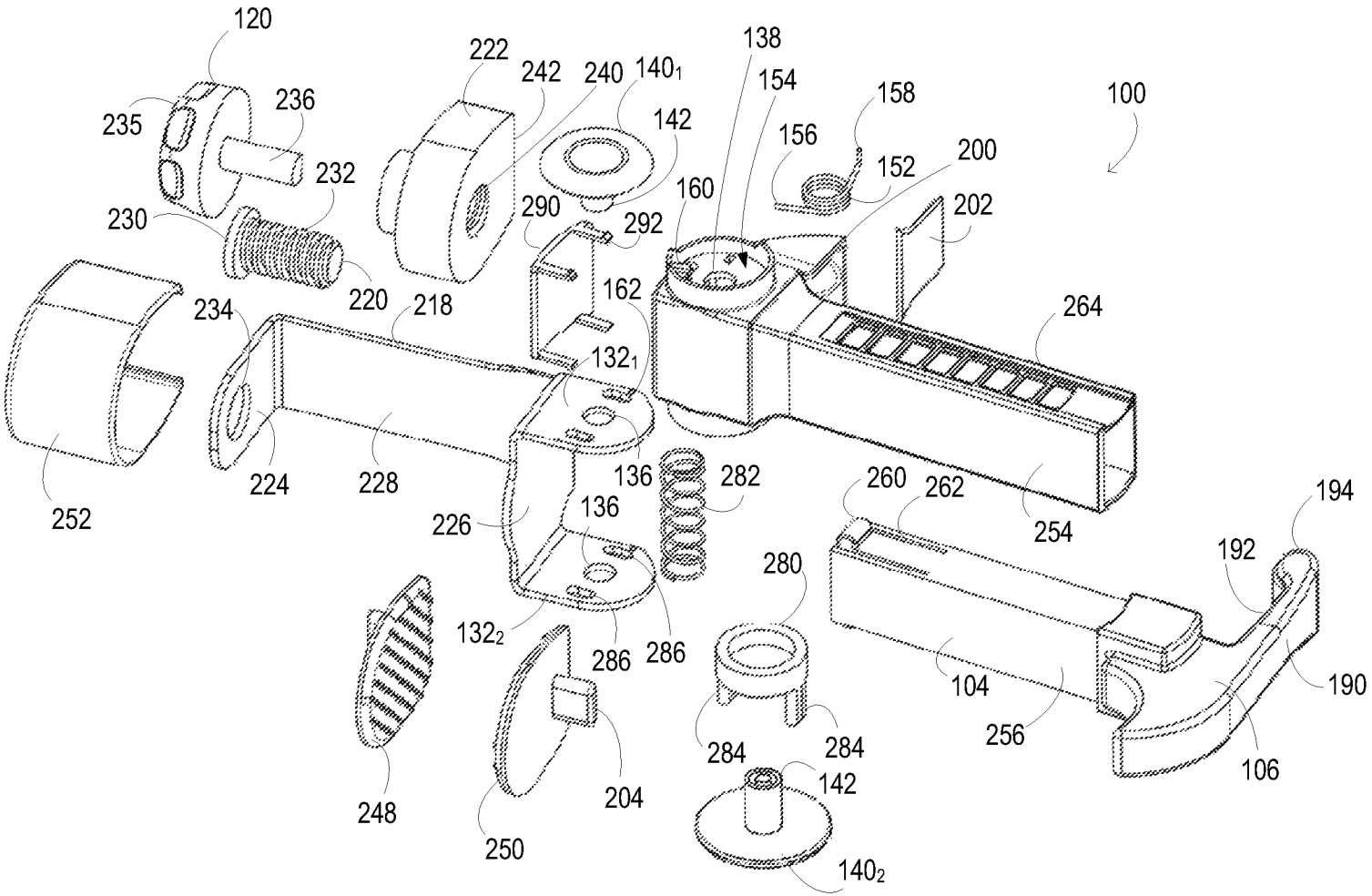
FIG. 19E is an exploded front perspective view of the portable door lock of FIG. 19A.

Reference is now made to FIGS. 18A-18C to illustrate an exemplary door locking process using portable door lock 100 of FIGS. 16A-16E. Referring to FIG. 18A, door mount 102 of portable door lock 100 is shown secured to vertical door edge 118 of door 206. At this point, deflection arm 104 is in its biased position and door frame engagement latch 106 is its door frame latching position. To begin the door locking process, door 206 is rotated so that vertical door edge 118 is brought closer to door frame 210 (i.e., door 206 is rotated toward its typical closed position).

FIG. 18B shows portable door lock 100 shortly after door frame engagement latch 106 contacts door frame 210. Door frame engagement latch 106 is now in a door frame gliding position. As compared to FIG. 18A, contact between door frame engagement latch 106 and door frame 210 has caused door frame engagement latch 106 to translate from the door frame latching position to the door frame gliding position. Elongated and curved distal face 298 can allow for smooth travel of door frame engagement latch 106 across door frame 210 (i.e., from proximal frame side 212 to distal frame side 214) as door 206 rotates toward its closed position.

Referring still to FIG. 18B, elongated and curved distal face 298 can be particularly helpful in promoting smooth travel as door frame engagement latch 106 travels across door stop 216 of door frame 210. As shown, door stop 216 projects from door frame 210 to impede door 206 from rotating past its closed position. In some embodiments, elongated and curved distal face 298 can be padded (e.g., with rubber or foam) and/or coated with a soft material to reduce or eliminate any potential damage to door frame 210 and/or door stop 216.

With continued reference to FIG. 18B, deflection arm 104 is shown in a deflected position. As compared to FIG. 18A, contact between door frame engagement latch 106 and door frame 210 has caused deflection arm 104 to rotate (i.e., deflect) from the biased position to the deflection position. Rotation of deflection arm 104 from the biased position to the deflected position can act to absorb at least a portion of the impact between door frame engagement latch 106 and door frame 210. Accordingly, the rotation of deflection arm 104 can facilitate smooth travel of door frame engagement latch 106 across door frame 210 as door 206 continues to rotate toward its closed position.

FIG. 18C shows portable door lock 100 after completion of the door locking process. Door frame engagement latch 106 has returned to its door frame latching position. Once door frame engagement latch 106 has traversed door frame 210, latch coil spring 308 (described above with reference to FIG. 16E) acts to move door frame engagement latch 106 from the door frame gliding position to the door frame latching position. As shown, plunger portion 294 of door frame engagement latch 106 engages distal frame side 214. This engagement can restrict door 206 from being rotated back toward an opened position.

Comparing FIG. 18C to FIG. 18B shows that deflection arm 104 has partially returned to its biased position. Once door frame engagement latch 106 traverses distal frame side 214, arm torsion spring 152 (FIG. 16E) exerts a force that causes deflection 104 to rotate toward the biased position. In some cases, deflection arm 104 may return all the way back to its biased position once door frame engagement latch 106 reaches distal frame side 214. The biasing of deflection arm 104 toward the biased position can help maintain the engagement between plunger portion 294 and distal frame side 214. That is, deflection arm 104 may supply a holding force that improves the strength of the connection between plunger portion 294 and distal frame side 214.

As shown in FIG. 18C, door frame bumper 200 acts to keep a gap G between vertical door edge 118 and proximal frame side 212. That is, door frame bumper 200 can keep door 206 partially open while it remains locked by door latch engagement latch 106.

Although door frame engagement latch 106 is shown engaged with distal frame side 214 in FIG. 18C, its configuration also allows it to engage with door stop 216. That is, plunger portion 294 can engage the distal side of door stop 216 to look door 206 (i.e., prevent door rotation toward an open position). In applications where the door is attached to a wall instead of a door frame, plunger portion 294 of door frame engagement latch 106 can engage with the distal side of that wall to lock the door. The illustrated configuration of door frame engagement latch 106 allows portable door lock 100 to be compatible in a wide variety of applications.

With continued reference to FIG. 18C, door 206 can be unlocked from either proximal frame side 212 or distal frame side 214. That is, door frame engagement latch 106 can be disengaged with distal frame side 214 from either proximal frame side 212 or distal frame side 214 of door frame 210. To unlock door 206 from the distal frame side 214, an external force can be applied to door frame engagement latch 106 and/or deflection arm 104 that causes deflection arm 104 to rotate away from door frame 210. Hook portion 296 of door frame engagement latch 106 provides a convenient gripping location where one can apply such an external force to disengage plunger portion 294 from distal from side 214. To unlock door 206 from the proximal frame side 212, an external force can be applied to door frame bumper 200 that causes deflection arm 104 to rotate away from door frame 210. Once deflection arm 104 is rotated a sufficient extent away from door frame 210, plunger portion 294 disengages distal frame end 214. Since portable door lock 100 is unlockable from both proximal and distal frame sides 212, 214, one cannot unintentionally lock themselves in regardless of which side of door 206 they are on.

Reference is now made to FIGS. 19A-19E. FIGS. 19A-19E show a portable door lock 100 in accordance with another embodiment. Portable door lock 100 shown in FIGS. 19A-19E is similar to portable door lock 100 shown in FIGS. 1A-1E, except for differences in the manner in which door frame engagement latch 106 is connected to deflection arm 104. Unless otherwise noted, like-numbered elements (i.e., elements having the same reference numerals) have similar structure and/or perform similar function as those in portable door lock 100 shown in FIGS. 1A-1E.

Door frame engagement latch 106 is rigidly connected to deflection arm 104 at a distal arm end 128. As a result, door frame engagement latch 106 does not move or rotate relative to deflection arm 104 in response to contact with the door frame. Door frame engagement latch 106 can be rigidly connected to proximal arm end 128 in any suitable fashion. For example, door frame engagement latch 106 can be rigidly connected to proximal arm end 128 with adhesives, machinal fasteners, or a combination thereof. Alternatively, door frame engagement latch 106 may be integral with deflection arm 104 (e.g., injection molded in the same mold). In the example shown, door frame engagement latch 106 is friction fit to proximal arm end 128.

Figure 20A:
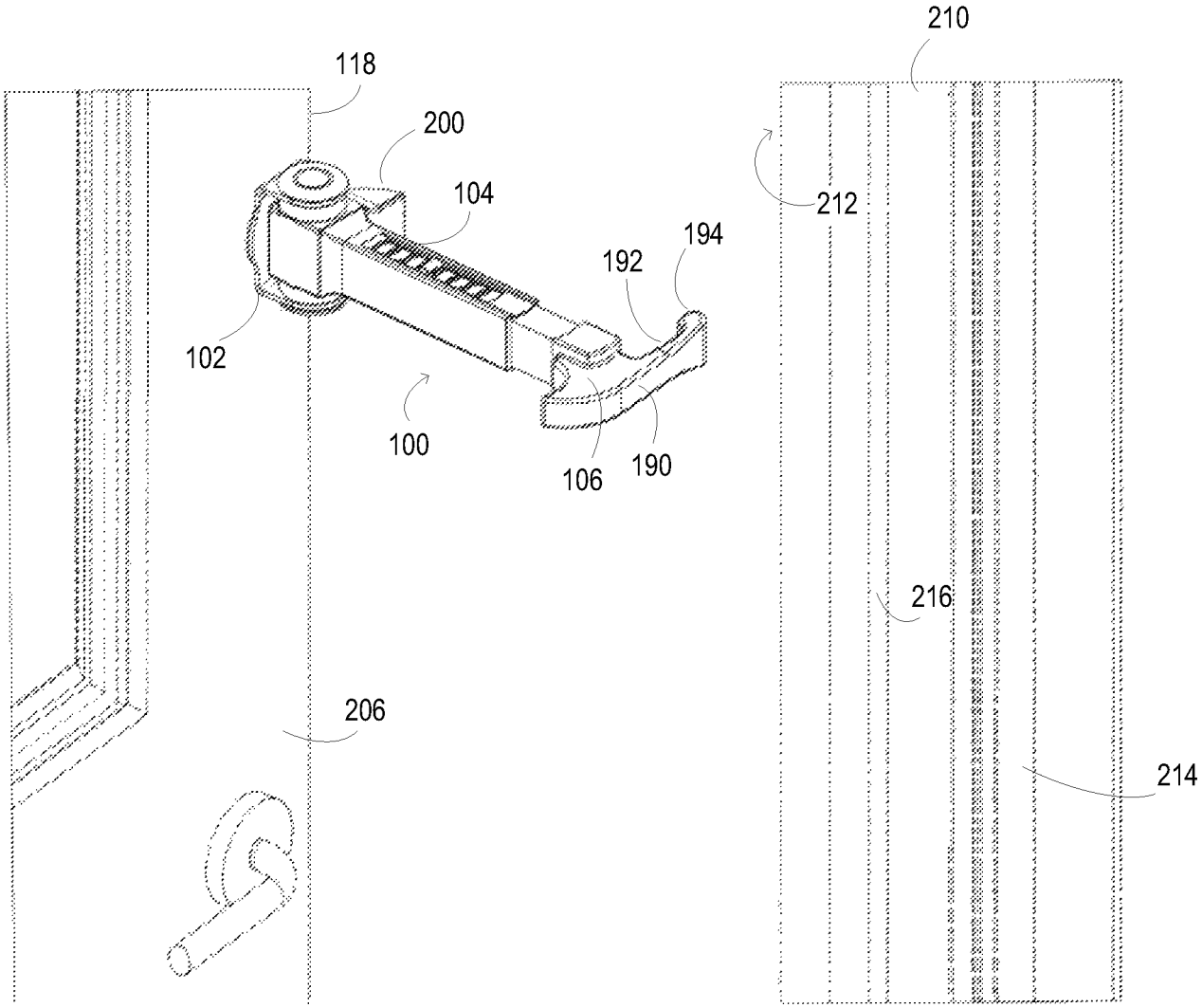
FIGS. 20A-20C are side perspective views illustrating an exemplary door locking process using the portable door lock of FIG. 19A.
Figure 20B:
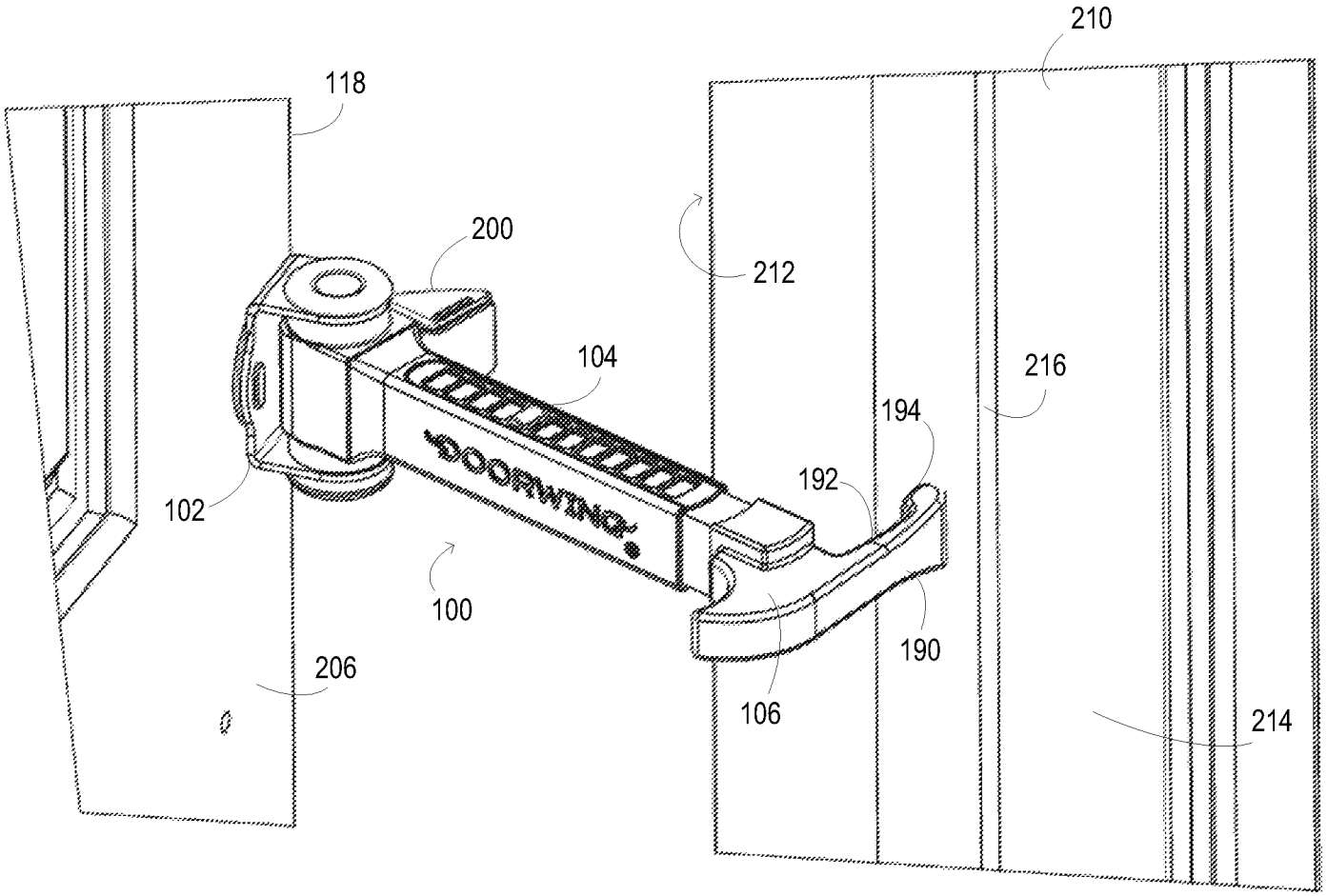
Figure 20C:
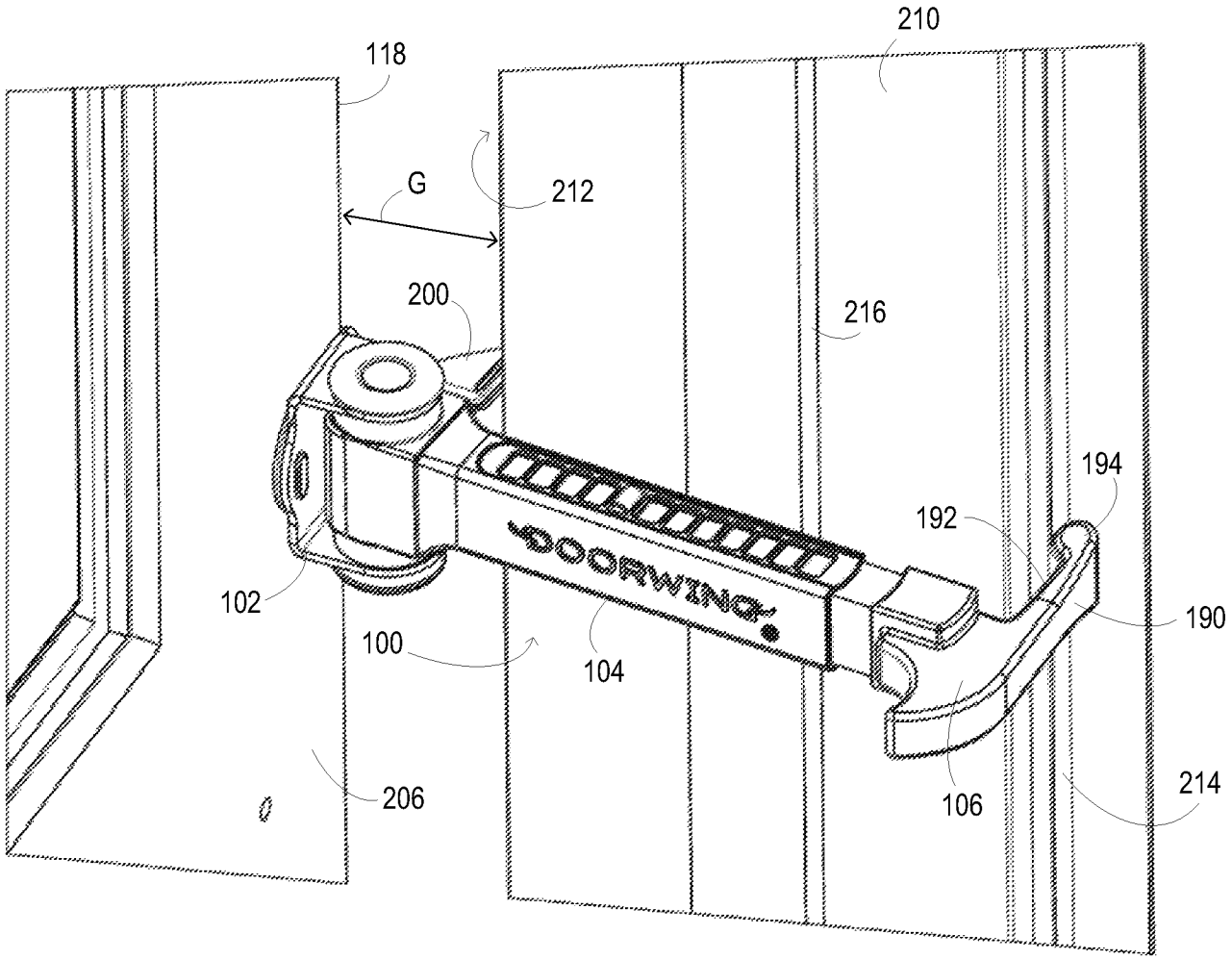

Reference is now made to FIGS. 20A-20C to illustrate an exemplary door locking process using portable door lock 100 of FIGS. 19A-19E. Referring to FIG. 20A, door mount 102 of portable door lock 100 is shown secured to vertical door edge 118 of door 206. At this point, deflection arm 104 is in its biased position. To begin the door locking process, door 206 is rotated so that vertical door edge 118 is brought closer to door frame 210 (i.e., door 206 is rotated toward its typical closed position).

FIG. 20B shows portable door lock 100 shortly after door frame engagement latch 106 contacts door frame 210. Deflection arm 104 is now in a deflected position. As compared to FIG. 20A, contact between door frame engagement latch 106 and door frame 210 has caused deflection arm 104 to rotate (i.e., deflect) from the biased position to the deflection position. Rotation of deflection arm 104 from the biased position to the deflected position allows door frame engagement latch 106 to accommodate for the contours of door frame 210 as it travels from proximal frame end 212 to distal frame end 214. Rounded retaining head 194 can allow for smooth travel of door frame engagement latch 106 across door frame 210 as door 206 rotates toward its closed position.

FIG. 20C shows portable door lock 100 after completion of the door locking process. As shown, finger portion 192 and rounded retaining head 194 of door frame engagement latch 106 engage distal frame side 214. This engagement can restrict door 206 from being rotated back toward an opened position. Comparing FIG. 20C to FIG. 20B shows that deflection arm 104 has partially returned to its biased position. Once door frame engagement latch 106 traverses distal frame side 214, arm torsion spring 152 (FIG. 19E) exerts a force that causes deflection 104 to rotate toward its biased position. In some cases, deflection arm 104 may return all the way back to its biased position once door frame engagement latch 106 reaches distal frame side 214. The biasing of deflection arm 104 toward the biased position can help maintain the engagement between rounded retaining head 194 and distal frame side 214. That is, deflection arm 104 may supply a holding force that improves the strength of the connection between rounded retaining head 194 and distal frame side 214.

As shown in FIG. 20C, door frame bumper 200 acts to keep a gap G between vertical door edge 118 and proximal frame side 212. That is, door frame bumper 200 can keep door 206 partially open while it remains locked by door frame engagement latch 106.

Figure 21:
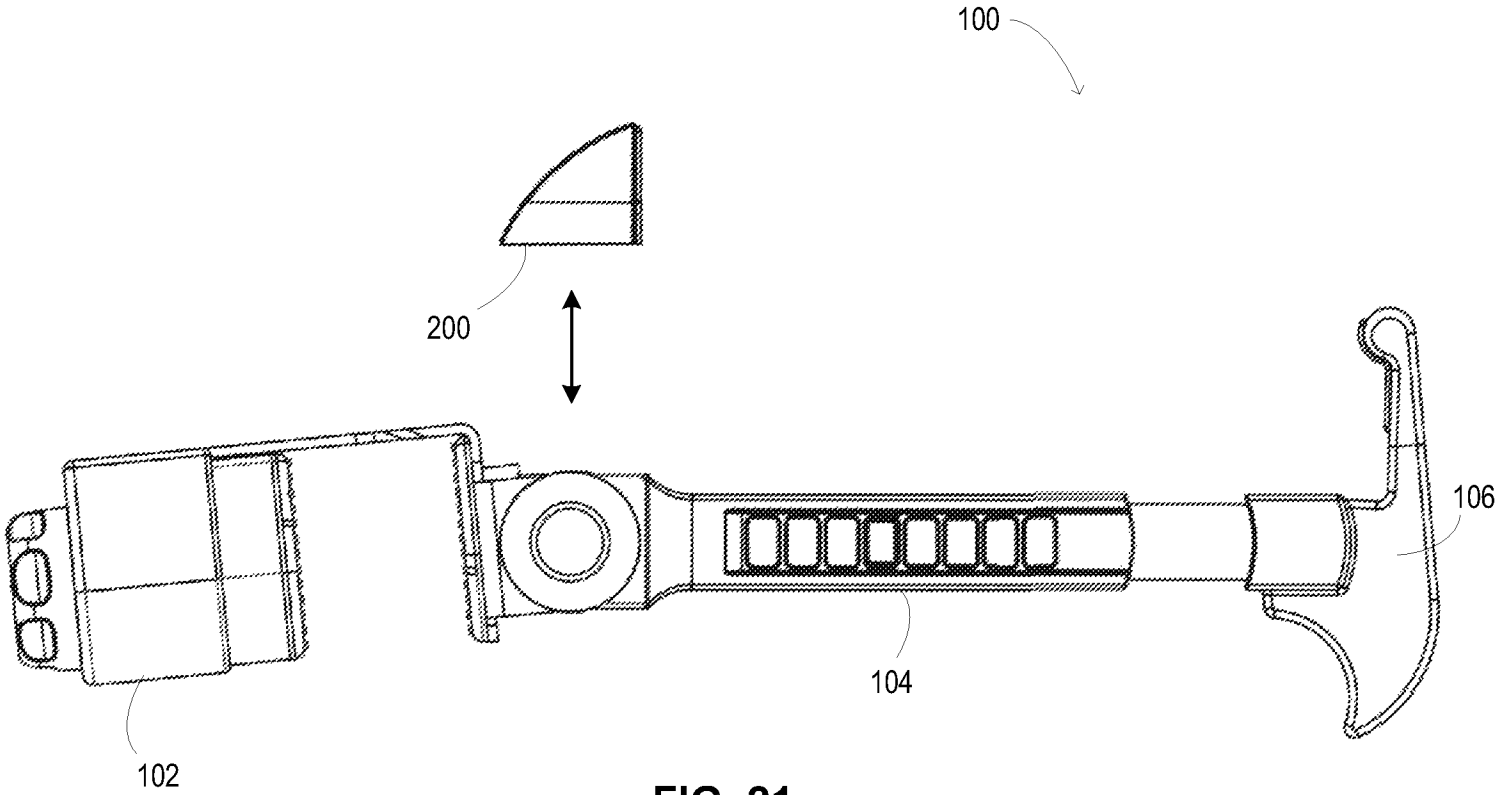
FIG. 21 is a top view of an example portable door lock that has a removable door frame bumper.

In some embodiments, door frame bumper 200 is removable from deflection arm 104. For example, FIG. 21 shows a portable door lock 100 in which door frame bumper 200 can be selectively removed from deflection arm 104. Door frame bumper 200 can be connected to deflection arm 104 in any manner that allows door frame bumper 200 to be attached, detached, and reattached to deflection arm 104. For example, door frame bumper 200 may be connected to deflection arm 104 with a loop and pile fastener, multi-use adhesive, snaps, etc. Removing door frame bumper 200 allows portable door lock 100 to be used as a door lock without the hand and/or finger injury protection afforded by door frame bumper 200. With door frame bumper 200 removed, the door can be fully closed while being locked via door frame engagement latch 106. In an alternative embodiment, door frame bumper 200 may collapse and/or be pressed into a cavity formed in deflection arm 104 when not needed.

Figure 22:
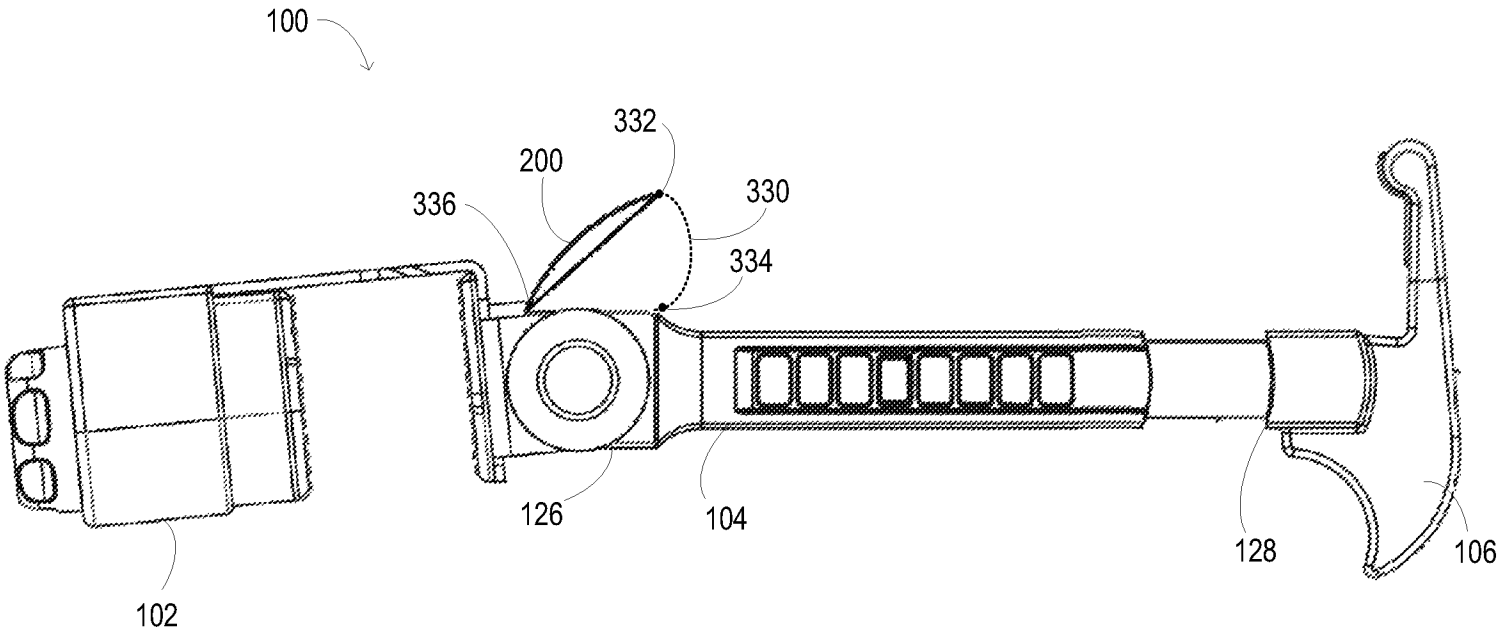
FIG. 22 is a top view of an example portable door lock that has a rotatable door frame bumper.

In some embodiments, door frame bumper 200 is rotatably connected to deflection arm 104. For example, FIG. 22 shows a portable door lock 100 in which door frame bumper 200 is rotatable relative to deflection arm 104 along an arcuate path 330 between an extended position 332 and a retracted position 334. Door frame bumper 200 can be connected to deflection arm 104 in any manner that allows door frame bumper 200 to rotate with respect to deflection arm 104. In the example shown, door frame bumper 200 is connected to deflection arm 104 at a bumper pivot joint 336 (e.g., a pin hinge).

Referring to FIG. 22, when door frame bumper 200 is in extended position 332, it extends transverse to the deflection arm 104 and extends outboard of door mount 102. As described above, by extending outboard of door mount 200, bumper 200 is obstructed from passing into the door opening during a locking process. Accordingly, when door frame bumper 200 is in extended position 332, it can keep the door slightly open and/or serve as a guard to protect against hand and finger injuries. Door frame bumper 200 can be selectively pivoted to retracted position 334 at times when maintaining a gap between the door and door frame is not desired and/or when protection from hand and finger injuries is not needed.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

ITEMS

Item 1: A portable door lock comprising:

a non-destructively removable door mount securable to a vertical door edge;

a deflection arm extending longitudinally from a proximal arm end to a distal arm end, the proximal arm end connected to the door mount, the deflection arm rotatable relative to the door mount between at least a biased position and a deflected position; and a door frame engagement latch connected to the deflection arm proximate the distal arm end, the door frame engagement latch movable relative to the deflection arm between at least a door frame latching position and a door frame gliding position, the door frame engagement latch biased toward the door frame latching position.

Item 2: A portable door lock comprising:

a non-destructively removable door mount securable to a vertical door edge;

a deflection arm extending longitudinally from a proximal arm end to a distal arm end, the proximal arm end connected to the door mount, the deflection arm rotatable relative to the door mount between at least a biased position and a deflected position; and a door frame engagement latch connected to the deflection arm proximate the distal arm end, the door frame engagement latch movable relative to the deflection arm between a door frame latching position and a disabled position.

Item 3: A portable door lock comprising:

a non-destructively removable door mount securable to a vertical door edge;

a rigid deflection arm including a first arm segment and a second arm segment, the first arm segment having a proximal arm end, the second arm segment having a distal arm end, the proximal arm end connected to the door mount, the deflection arm rotatable relative to the door mount between at least a biased position and a deflected position, the deflection arm having an arm length from the proximal arm end to the distal arm end, and the second arm segment being movable relative to the first arm segment to vary the arm length; and a door frame engagement latch connected to the second arm segment proximate the distal arm end.

Item 4: A portable door lock comprising:

a non-destructively removable door mount securable to a vertical door edge;

a longitudinally extending deflection arm having a proximal arm end and an opposed distal arm end, the proximal arm end connected to the door mount, the deflection arm rotatable relative to the door mount between at least a biased position and a deflected position, the deflection arm including a door frame bumper proximate the proximal arm end, the door frame bumper extending transverse to the deflection arm, the door frame bumper extending laterally outboard of the door mount when the deflection arm is in the deflected position; and a door frame engagement latch connected to the deflection arm proximate the distal arm end.

Item 5: The portable door lock of any preceding item, wherein:

the door frame engagement latch is movable relative to the deflection arm between at least a door frame latching position and a door frame gliding position, and the door frame engagement latch is biased toward the door frame latching position.

Item 6: The portable door lock of any preceding item, wherein:

the door frame engagement latch is rotatable relative to the deflection arm about a latch axis between at least the door frame gliding position and the door frame latching position, the latch axis extending transverse to the deflection arm.

Item 7: The portable door lock of any preceding item, wherein:

the proximal and distal arm ends are located on an arm axis, and the latch axis extends transverse to the arm axis.

Item 8: The portable door lock of any preceding item, wherein:

the door frame engagement latch is connected to the deflection arm by a latch pivot joint, and the latch pivot joint includes a torsion spring that biases the door frame engagement latch toward the door frame latching position.

Item 9: The portable door lock of any preceding item, wherein:

the door frame engagement latch includes a finger portion, the finger portion extending transverse to the deflection arm when the door frame engagement latch is in the door latching position.

Item 10: The portable door lock of any preceding item, wherein:

the finger portion includes a rounded retaining head at a distal end thereof.

Item 11: The portable door lock of any preceding item, wherein:

the finger portion has a finger length of at least 3 cm.

Item 12: The portable door lock of any preceding item, wherein:

the door frame engagement latch is rotatable about the latch axis from the door frame latching position, through the door frame gliding position, to a disabled position.

Item 13: The portable door lock of any preceding item, wherein:

the door frame engagement latch is rotated at least 75 degrees between the door frame latching position and the disabled position.

Item 14: The portable door lock of any preceding item, wherein:

at least one of the deflection arm and the door frame engagement latch have a retaining member that retains the door frame engagement latch in the disabled position when the door engagement latch is in the disabled position.

Item 15: The portable door lock of any preceding item, wherein:

the door frame engagement latch is rotated between 35 and 100 degrees from the door frame latching position to the door frame gliding position.

Item 16: The portable door lock of any preceding item, wherein:

the deflection arm is rotatable from the biased position, through the deflected position, to a stowed position.

Item 17: The portable door lock of any preceding item, wherein:

the deflection arm is rotated at least 70 degrees between the biased position and the stowed position.

Item 18: The portable door lock of any preceding item, wherein:

at least one of the door mount and the deflection arm have a retainer that retains the deflection arm in the stowed position when the deflection arm is in the stowed position.

Item 19: The portable door lock of any preceding item, wherein:

the door mount comprises a clamp, the clamp including spaced apart opposed first and second jaws joined by a planar jamb member.

Item 20: The portable door lock of any preceding item, wherein:

the first and second jaws define a door clamping gap therebetween, and at least one of the first and second jaws is movable relative to the planar jamb member to adjust the door clamping gap.

Item 21: The portable door lock of any preceding item, wherein:

the planar jamb member is a unitary piece of sheet metal.

Item 22: The portable door lock of any preceding item, wherein:

the deflection arm is rotated between 0 and 30 degrees from the biased position to the deflected position.

Item 23: The portable door lock of any preceding item, wherein:

the proximal arm end is connected to the door bracket by an arm pivot joint and the arm pivot joint includes a torsion spring that biases the deflection arm toward the biased position.

Item 24: The portable door lock of any preceding item, wherein:

the deflection arm is rotatable relative to the door mount about a deflection axis between at least the biased position and the deflected position, the deflection axis extending transverse to the deflection arm.

Item 25: The portable door lock of any preceding item, wherein:

the door frame engagement latch is movable from the door frame latching position, through the door frame gliding position, to a disabled position.

Item 26: The portable door lock of any preceding item, wherein:

the door frame engagement latch includes a finger portion, the finger portion extending generally parallel to the deflection arm when the door frame engagement latch is in the disabled position.

Item 27: The portable door lock of any preceding item, wherein:

the deflection arm includes a first arm segment and a second arm segment, the first arm segment having the proximal arm end, the second arm segment having the distal arm end, the deflection arm having an arm length from the proximal arm end to the distal arm end, and the second arm segment being movable relative to the first arm segment to vary the arm length, and the door frame engagement latch is connected to the second arm segment proximate the distal arm end.

Item 28: The portable door lock of any preceding item, wherein:

the second arm segment is telescopically connected to the first arm segment.

Item 29: The portable door lock of any preceding item, wherein:

the arm length has a stroke of at least 5 cm between a maximum arm length and a minimum arm length.

Item 30: The portable door lock of any preceding item, wherein:

the arm length is variable in regular increments.

Item 31: The portable door lock of any preceding item, wherein:

the door frame engagement latch is removably connected to the deflection arm, and the door frame engagement latch is movable from the door frame latching position to the disabled position by disconnecting the door frame engagement latch from the deflection arm.

Item 32: The portable door lock of any preceding item, wherein:

the door frame engagement latch is only movable between the door frame latching position and the disabled position.

Item 33: The portable door lock of any preceding item, wherein:

the door frame engagement latch is snapped into the disabled position.

Item 34: The portable door lock of any preceding item, wherein:

the deflection arm includes a door frame bumper proximate the proximal arm end, the door frame bumper extending transverse to the deflection arm, the door frame bumper extending laterally outboard of the door mount when the deflection arm is in the deflected position.

Item 35: The portable door lock of any preceding item, wherein:

the door frame bumper is movable relative to the deflection arm between an extended position and a retracted position, the door frame bumper extending transverse to the deflection arm in the extended position.

Item 36: The portable door lock of any preceding item, wherein:

the door frame bumper is connected to the deflection arm by a bumper pivot joint.

Item 37: The portable door lock of any preceding item, wherein:

the door frame bumper is rotatable relative to the deflection arm between an extended position and a retracted position, the door frame bumper extending transverse to the deflection arm in the extended position.

Item 38: The portable door lock of any preceding item, wherein:

the door frame bumper is removably connected to the deflection arm.

The invention claimed is:

1. A portable door lock comprising:

a non-destructively removable door mount securable to a vertical door edge;

a deflection arm extending longitudinally from a distal arm end to a proximal arm end, the proximal arm end connected to the door mount, the deflection arm rotatable relative to the door mount between at least a biased position and a deflected position; and a door frame engagement latch connected to the deflection arm proximate the distal arm end, the door frame engagement latch rotatable relative to the deflection arm between at least a door frame latching position and a door frame gliding position, the door frame engagement latch biased to rotate toward the door frame latching position, wherein the door frame engagement latch is rotatable relative to the deflection arm about a latch axis between at least the door frame gliding position and the door frame latching position, the latch axis extending transverse to the deflection arm.

2. The door lock of claim 1, wherein the proximal and distal arm ends are located on an arm axis, and the latch axis extends transverse to the arm axis.

3. The door lock of claim 1, wherein the door frame engagement latch is connected to the deflection arm by a latch pivot joint, and the latch pivot joint includes a torsion spring that biases the door frame engagement latch toward the door frame latching position.

4. The door lock of claim 1, wherein the door frame engagement latch includes a finger portion, the finger portion extending transverse to the deflection arm when the door frame engagement latch is in the door latching position.

5. The door lock of claim 4, wherein the finger portion includes a rounded retaining head at a distal end thereof.

6. The door lock of claim 1, wherein the door frame engagement latch is rotatable about the latch axis from the door frame latching position, through the door frame gliding position, to a disabled position.

7. The door lock of claim 6, wherein the door frame engagement latch is rotated at least 75 degrees between the door frame latching position and the disabled position.

8. The door lock of claim 6, wherein at least one of the deflection arm and the door frame engagement latch have a retaining member that retains the door frame engagement latch in the disabled position when the door frame engagement latch is in the disabled position.

9. The door lock of claim 1, wherein the door frame engagement latch is rotated between 35 and 100 degrees from the door frame latching position to the door frame gliding position.

10. The door lock of claim 1, wherein the deflection arm is rotatable from the biased position, through the deflected position, to a stowed position.

11. The door lock of claim 10, wherein the deflection arm is rotated at least 70 degrees between the biased position and the stowed position.

* * * * *